US005744278A

United States Patent [19]

Ayaki et al.

[11] Patent Number: 5,744,278

[45] Date of Patent: Apr. 28, 1998

[54] TONER FOR DEVELOPING AN ELECTROSTATIC IMAGE AND PROCESS FOR PRODUCING A TONER

[75] Inventors: Yasukazu Ayaki, Numazu; Takeshi Ikeda, Kawasaki; Tetsuro Fukui, Yokohama; Yoshinobu Baba, Yokohama; Hitoshi Itabashi, Yokohama; Yayoi Nagao, Mishima, all of Japan

[73] Assignee: Canon Kabushiki Kaisha, Tokyo, Japan

[21] Appl. No.: 835,878

[22] Filed: Apr. 8, 1997

[30] Foreign Application Priority Data

| | | | |
|---|---|---|---|
| Apr. 9, 1996 | [JP] | Japan | 8-111165 |
| Feb. 28, 1997 | [JP] | Japan | 9-045658 |

[51] Int. Cl.[6] ..... G03G 9/087

[52] U.S. Cl. ..... 430/110; 430/137; 430/138

[58] Field of Search ..... 430/109, 112, 430/106, 137, 138

[56] References Cited

U.S. PATENT DOCUMENTS

| | | | |
|---|---|---|---|
| 2,297,691 | 10/1942 | Carlson | 95/5 |
| 5,340,677 | 8/1994 | Baba et al. | 430/106.6 |
| 5,624,779 | 4/1997 | Nakayama | 430/137 |
| 5,629,121 | 5/1997 | Nakayama | 430/137 |

FOREIGN PATENT DOCUMENTS

| | | |
|---|---|---|
| 42-23910 | 11/1967 | Japan . |
| 43-24748 | 10/1968 | Japan . |
| 5-93002 | 4/1993 | Japan . |
| 6-52432 | 7/1994 | Japan . |
| 6-58543 | 8/1994 | Japan . |
| 6-58544 | 8/1994 | Japan . |

*Primary Examiner*—John Goodrow

*Attorney, Agent, or Firm*—Fitzpatrick, Cella, Harper & Scinto

[57] ABSTRACT

A toner for electrophotography contains at least a colorant and a binder resin, and (i) contains 0.1 to 15 parts by weight of colorant per 100 parts by weight of binder resin, (ii) has a number average particle size of 0.5 to 6.0 μm, (iii) has a coefficient of variation of 20% or less based on a number distribution, and (iv) has a capsule structure containing a shell layer and a core. The toner has solvent-mixture-soluble resin components extracted with a solvent mixture of ethanol and methyl ethyl ketone wherein the maximum glass transition temperature (Tg1) of a first soluble resin component obtained by extracting until 10% by weight of the total weight of the solvent-mixture-soluble resin components, and the maximum glass transition temperature (Tg2) of a second soluble resin component of the remainder satisfy the following relations:

$Tg1 > Tg2$ and $Tg1 \geq 50°$ C.

26 Claims, 6 Drawing Sheets

TONER FOR DEVELOPING AN ELECTROSTATIC IMAGE AND PROCESS FOR PRODUCING A TONER

BACKGROUND OF THE INVENTION

1. Field of the Invention

The present invention relates to a toner for developing an electrostatic latent image, and a process for producing the toner.

2. Description of the Prior Art

As electrophotographic processes, many processes have been known, as disclosed in U.S. Pat. No. 2,297,691, and Japanese Patent Examined Publication Nos. 42-23910 and 43-24748. In general in electrophotography, an electrical latent image is formed on a photosensitive member by any one of various means using a photoconductive material, developed with a toner, transferred to a transfer material such as paper or the like by using direct or indirect means according to demand, and then fixed by heating, pressing, heating and pressing or solvent vapor to obtain a copy or a print. The untransferred residual toner on the photosensitive member is cleaned off by one of various methods according to demand. The above process is repeated as needed.

The above-mentioned toner generally comprises particles containing a binder resin and a colorant, and, if required, a charge control agent and a fixing auxiliary. The particle size is generally within the range of several microns to 30 microns. Such a toner is generally produced by a so-called grinding method in which a colorant such as a dye, a pigment or a magnetic material is mixed with a thermoplastic resin, and the resultant mixture is melted to uniformly disperse the colorant in the thermoplastic resin, and then ground and classified.

An image forming apparatus using electrophotography has recently begun to be widely used as not only a copying machine for simply copying general originals but also as a printer, as an output device for high-quality full color images or a high-definition output device of a computer. In addition, since computers have been widely used for various purposes, the printer has been used in the personal field. Accordingly, the need to decrease the fixing temperature is important to decrease power consumption.

As a result, the required performance of the toner is increasingly advanced, and an excellent image cannot be formed unless the performances such as image quality, fixing properties, etc. can be improved by improving the toner itself.

One means to achieve a high image quality is to decrease the particle size of the toner. Image quality and resolution can be certainly improved by decreasing the particle size to several microns.

However, if the particle size of the toner produced by a conventional grinding method is decreased by applying a strong impact thereto, unground particles are fused to the grinding device used, thereby making it difficult to decrease the particle size to 5 to 6 microns. Furthermore, if the particle size of the toner is decreased, the cohesive force of particles makes it difficult to obtain a sharp particle distribution by classification. As a result, the charge of the toner cannot be easily controlled, and scattering and fogging occur in images.

In order to decrease the particle size of the toner and improve the sharpness of the particle distribution, a toner produced by a polymerization method has been proposed. For example, Japanese Patent Publication No. 6-52432 and Japanese Patent Application Laid-Open No. 5-93002 disclose methods of producing particles of about 1 to 10 μm having a sharp particle size distribution. In addition, Japanese Patent Publication Nos. 6-58543 and 6-58544 disclose methods of producing particles for forming images which have a sharp particle size distribution and which are coated with a colorant or a conductive agent and a binder so as to stabilize charge characteristics and improve performance.

However, while these particles having a sharp particle size distribution are excellent in fluidity, they create a problem by causing aggregation of a toner in closest packing when the toner is allowed to stand, and, particularly, to remain in an environment of high temperature. The particles coated with the colorant or the conductive agent for attaining the above effect have a problem in more easily causing aggregation of a toner due to nonuniformity in fine portions on the toner surfaces in closest packing. The aggregation of a toner or developer readily causes the problem of charging error and, consequently, deteriorating the resolution of the developed image.

As the particle size of the toner increases, this causes a critical problem when the glass transition temperature or the average molecular weight of the binder resin is decreased for achieving low-temperature fixing.

SUMMARY OF THE INVENTION

Accordingly, an object of the present invention is to provide a toner for developing an electrostatic image in which the above problems are solved, and a process for producing the toner.

Another object of the present invention is to provide a toner for developing an electrostatic image which satisfies the high quality and low-temperature fixing properties of an image and which has a stable fine particle size and a sharp particle size distribution at a high temperature, and a process for producing the toner.

A further object of the present invention is to provide a toner for developing an electrostatic image which causes no aggregation thereof and aggregation of a developer when being allowed to stand at a high temperature, which has excellent fluidity, which can efficiently be charged, and which can form a high-quality image, and a process for producing the toner.

In order to achieve the objects, in accordance with an aspect of the present invention, there is provided a toner for developing an electrostatic image comprising at least a binder resin and a colorant, wherein:

the toner (i) contains 0.1 to 15 parts by weight of colorant per 100 parts by weight of binder resin, (ii) has a number average particle size of 0.5 to 6.0 μm, (iii) has a coefficient of variation of 20% or less based on a number distribution, and (iv) has a capsule structure comprising a shell layer and a core part; and has solvent-mixture-soluble resin components extracted with a solvent mixture of ethanol (EtOH) and methyl ethyl ketone (MEK), the maximum glass transition temperature (Tg1) of a first soluble resin component obtained by extracting until 10% by weight of the total weight of the solvent mixture soluble resin components, and the maximum glass transition temperature (Tg2) of a second soluble resin component of the remainder satisfy the following relations:

$$Tg1>Tg2 \text{ and } Tg1\geqq 50^\circ C.$$

In order to achieve the objects, in accordance with another aspect of the present invention, there is provided a process for producing a toner comprising the steps of:

dissolving, in a polymerization solvent, a first polymerizable monomer which is soluble in the polymerization solvent and which, by polymerization, produces a polymer insoluble in the polymerization solvent, and a polymer composition, to prepare a polymerization reaction system;

polymerizing the first polymerizable monomer in the presence of a polymerization initiator in the polymerization reaction system wherein dissolved oxygen in the polymerization reaction system is initially set to 2.0 mg/l;

after polymerizing at least 50% of the first polymerizable monomer, adding to the polymerization reaction system, a second polymerizable monomer which is soluble in the polymerization solvent, and which, by polymerization, produces a polymer insoluble in the polymerization solvent and from which a polymer having a higher glass transition temperature than that of the polymer synthesized from the first polymerizable monomer can be synthesized;

polymerizing the second polymerizable monomer in the polymerization reaction system;

recovering polymerization particles from the polymerization reaction system; and producing a toner comprising at least a colorant and a binder resin from the resultant polymerization particles; wherein;

the toner (i) contains 0.1 to 15 parts by weight of colorant relative to 100 parts by weight of binder resin, (ii) has a number average particle size of 0.5 to 6.0 μm, (iii) has a coefficient of variation of 20% or less based on a number distribution, and (iv) has a capsule structure comprising a shell layer and a core; and said toner has solvent-mixture-soluble resin components extracted with a solvent mixture of ethanol (EtOH) and methyl ethyl ketone (MEK), the maximum glass transition temperature (Tg1) of a first soluble resin component obtained by extracting until 10% by weight of the total weight of the solvent-mixture-soluble resin components, and the maximum glass transition temperature (Tg2) of a second soluble resin component of the remainder satisfy the following relations:

$$Tg1>Tg2 \text{ and } Tg1\geqq 50^\circ \text{ C.}$$

DETAILED DESCRIPTION OF THE INVENTION

Figure 1:
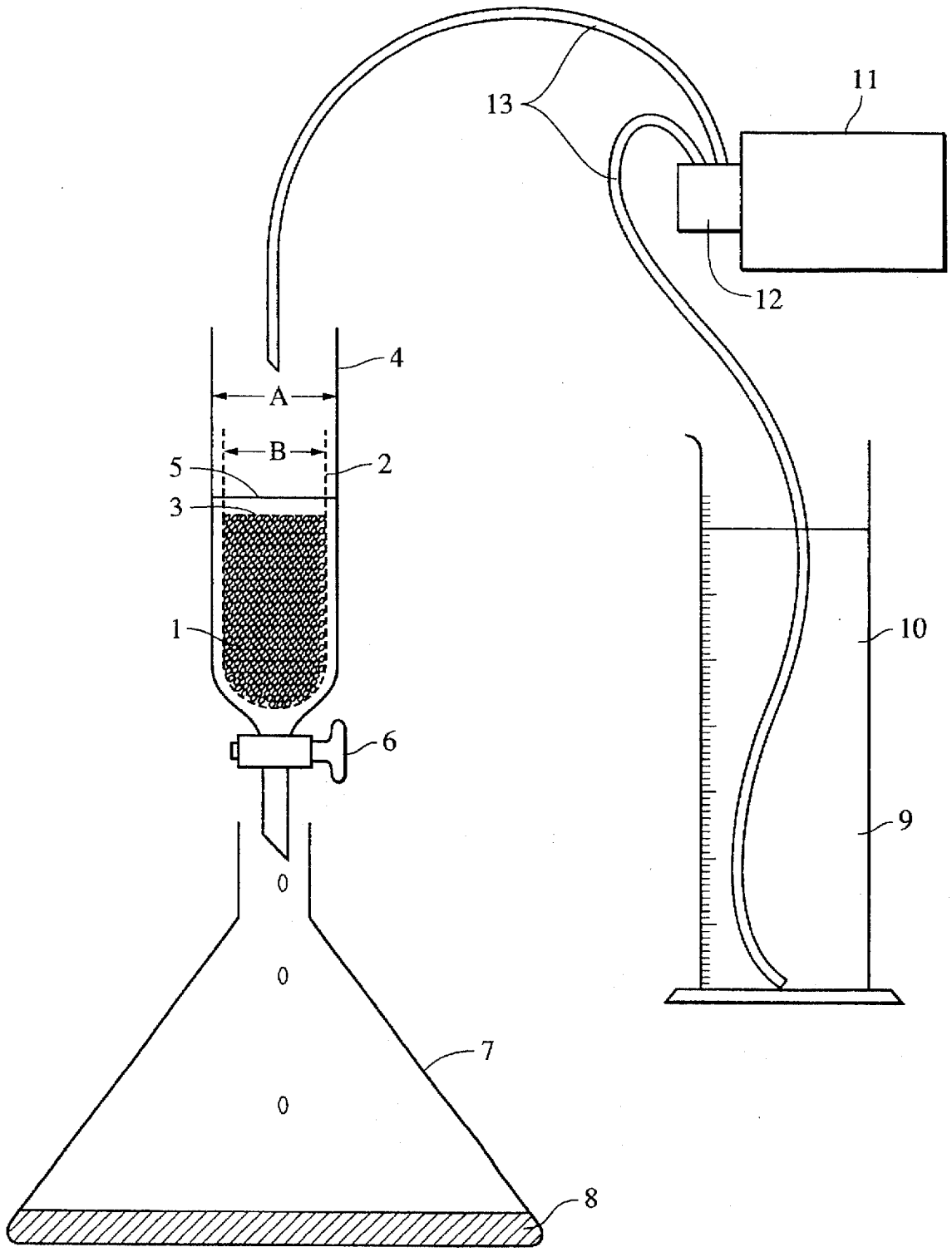
FIG. 1 is a drawing illustrating an extractor for extracting solvent mixture soluble resin components of a toner in accordance with the present invention.

In a toner for developing an electrostatic image in accordance with an aspect of the present invention, the number average particle size is within the range of 0.5 to 6.0 μm, the coefficient of variation of within the range of 20% or less based on a number distribution. With respect to the solvent mixture soluble resin components extracted with a solvent mixture of ethanol (EtOH) and methyl ethyl ketone (MEK), the maximum glass transition temperature (Tg1) of the first soluble resin component obtained by extracting until 10% by weight of the total weight, i.e., the toner surface or shell layer, and the maximum glass transition temperature (Tg2) of the second soluble resin component of the remainder, i.e., the core portion of the toner, satisfy the following relations:

$$Tg1>Tg2 \text{ and } Tg1\geqq 50^\circ \text{ C.}$$

As a result of detailed examination, the inventors found that the fine particle toner having an average particle size of 0.5 to 6.0 μm permits faithful development of a latent image. It was also found that in order to suppress variations in charging, it is necessary for such a fine particle toner to have a coefficient of variation within the range of 20% or less based on a number distribution. It was further found to be effective that the toner having a uniform and fine particle size and comprising the core resin portion having a low glass transition temperature so as to improve low-temperature fixing properties has a resin layer which has a higher glass transition temperature than that of the core portion of the toner and which is provided on the toner surface or shell in order to prevent packing and concurrent aggregation thereof when the toner is allowed to stand, particularly, in an environment of high temperature.

Of the solvent mixture soluble resin components extracted with a solvent mixture of ethanol (EtOH) and methyl ethyl ketone (MEK), the first soluble resin component obtained until 10% by weight of the total weight of the solvent mixture soluble resin components is extracted from the start of extraction, i.e., the component of the toner surface layer, is thought to mainly consist of the binder resin of the toner surface layer, but contain some residual monomer, the initiator and other additives.

Therefore, in the present invention, with respect to the first soluble resin component extracted with the solvent mixture of ethanol (EtOH) and methyl ethyl ketone (MEK), the glass transition temperature of a portion which shows the maximum width of endotherm is considered as the glass transition temperature of the surface or shell layer, i.e., the maximum glass transition temperature (Tg1) thereof. Of the second soluble resin component of the remainder extracted to the end of extraction after 10% by weight is extracted from the start of extraction, i.e., the core portion of the toner, the glass transition temperature of a portion which shows the maximum width of endotherm is considered as the maximum glass transition temperature (Tg2) of the core portion.

The measurement of the glass transition temperature will be described in detail in the description of the measurement methods below.

Furthermore, in the present invention, the maximum glass transition temperature (Tg1) of the surface layer portion and the maximum glass transition temperature (Tg2) of the core portion preferably satisfy the following relations:

$$Tg1>Tg2 \text{ and } Tg1\geqq 50^\circ \text{ C.,}$$

more preferably the following relations:

$$Tg1-Tg2\geqq 20^\circ \text{ C. and } Tg1\geqq 50^\circ \text{ C.}$$

This makes it possible to prevent aggregation at a high temperature while maintaining low-temperature fixing properties.

From the viewpoint of low-temperature fixing properties, Tg2 is preferably less than 50° C. because the fixing temperature is low.

In the present invention, the capsule structure having the surface or shell layer and the core or nuclear portion includes a capsule structure having a single core (or nuclear) portion and a surface layer, and a capsule structure comprising a domain-matrix structure having a plurality of cores (or nuclei) dispersed in a resin which constitutes a surface or shell layer.

In addition, if the radius of the toner having a capsule structure is r1, and the distance to a single core or the surface of one of a plurality of cores which is at the minimum distance from the toner surface is r2, in order to improve the low-temperature fixing properties while satisfying anti-aggregation properties, the following relation is satisfied:

$$1.1 \leqq r1/r2 \leqq 100.$$

Furthermore, the tetrahydrofuran (or THF)-soluble contents of the binder resin component of the toner contain 0.5% by weight or less of components having molecular weights of 1000 or less in the GPC molecular weight distribution, thereby increasing the effect of maintaining stability at high temperatures.

The toner of the present invention is preferably produced directly by a polymerization method. Particularly, the toner is preferably produced by the method comprising the steps of:

(a) dissolving, in a polymerization solvent, a first polymerizable monomer which is soluble in the polymerization solvent and which, by polymerization, produces a polymer insoluble in the polymerization solvent, and a polymer composition, to prepare a polymerization reaction system;

(b) polymerizing the first polymerizable monomer in the presence of a polymerization initiator in the polymerization reaction system with (the amount of the) dissolved oxygen in the polymerization reaction system initially set to 2.0 mg/l (at the start of polymerization reaction);

when the conversion degree of polymerization of the first polymerizable monomer reaches 50% or more, (i.e., after polymerizing at least 50% of the first polymerizable monomer) adding, to the polymerization reaction system, a second polymerizable monomer which is soluble in the polymerization solvent, and which, by polymerization, produces a polymer insoluble in the polymerization solvent and from which a polymer having a higher glass transition temperature than that of the polymer synthesized from the first polymerizable monomer can be synthesized;

(d) polymerizing the second polymerizable monomer in the polymerization reaction system;

(e) recovering polymerization particles from the polymerization reaction system; and (f) producing a toner from the resultant polymerization particles.

The start of polymerization with the amount of dissolved oxygen set to 2.0 mg/l or less at the start of polymerization makes it possible (i) that, for example, when the glass transition temperature is set to a desired value (Tg is less than 50° C.), the set copolymerization ratio 1:1 by weight of the resin composition, which constitutes the core or nuclear portion, can be obtained by copolymerizing two polymerizable monomers A and B as the first polymerizable monomers for forming the core or nuclear portion at a ratio by weight of 1:1, and (ii) that the grain size distribution within the range of the present invention can be obtained. At the same time, the second polymerizable monomer from which a polymer having a higher glass transition temperature than that of a polymer synthesized from the first polymerizable monomer can be synthesized is added to form the surface layer when the conversion degree of polymerization reaches 50% or more so as to finally improve the adhesion between the soft inside and the hard surface layer, and attain high uniformity in the surface. This also possibly facilitates the prevention of packing at high temperatures without deteriorating the fixing properties.

The construction of the present invention will be described in detail below.

In the present invention, it is important that the number average particle size of the toner is 0.5 to 6.0 μm, preferably 1.0 to 5.0 μm. This is necessary for obtaining high-definition images. With a number average particle size of less than 0.5 μm, the toner is difficult to handle as a dry powder, while with a number average particle size of over 6.0 μm, a micro-dot latent image cannot be faithfully developed, thereby deteriorating the reproducibility of an extremely high light portion.

In accordance with the present invention, the coefficient of variation based on the number distribution of the toner is 20% or less, preferably 18% or less.

The coefficient of variation based on the number distribution of the toner is computed by the following equation:

$$\text{Coefficient of variation } (\%) = (SD/D_n) \times 100$$

wherein

SD: standard deviation of number distribution $D_n$: number average particle size In the present invention, the average particle size and the particle size distribution of the toner greatly contribute to the image reproducibility, particularly, in the transfer process. Namely, if the coefficient of variation exceeds 20%, even with the average particle size within the range of the present invention, development is good, but the reproducibility of a halftone image deteriorates due to the presence of toner which is scattered or not transferred due to variation in charging during transfer.

In the present invention, it is preferable that the maximum glass transition temperature (Tg1) of the first soluble resin component extracted from the surface layer and the maximum glass transition temperature (Tg2) of the second soluble resin component of the remainder, i.e., the nuclear portion, satisfy the relation (Tg1)>(Tg2), and the maximum glass transition temperature (Tg1) of the surface layer is 50° C. or more.

When the maximum glass transition temperature (Tg1) of the first soluble resin component is lower than the maximum glass transition temperature (Tg2) of the second soluble resin component, i.e., when Tg1≦Tg2, the toner surface becomes too soft, and thus the development properties and anti-blocking properties cannot be satisfied at high temperatures.

When the maximum glass transition temperature (Tg1) of the first soluble resin component is less than 50° C., the toner particles easily aggregate due to packing.

In the present invention, the maximum glass transition temperature (Tg1) of the first soluble resin component and the maximum glass transition temperature (Tg2) of the second soluble resin component more preferably satisfy the following relations:

$$Tg1 - Tg2 \geqq 20°\ C. \text{ and } Tg1 \geqq 50°\ C.,$$

most preferably the following relations:

$$80° C. \geqq Tg1-Tg2 \geqq 30° C. \text{ and } Tg1 \geqq 50° C.$$

In order that the toner of the present invention sufficiently exhibit the low-temperature fixing properties and anti-packing effect, it is preferable that the maximum glass transition temperature of the first soluble resin component is 50° to 150° C., more preferably 60° to 120° C.

If the maximum glass transition temperature exceeds 150° C., aggregation and packing can be prevented, but the low-temperature fixing properties cannot be sufficiently satisfied in some cases.

In the present invention, the maximum glass transition temperature (Tg2) of the second soluble resin component is preferably less than 50° C. from the viewpoint of the low-temperature fixing properties of toner.

In order to improve the anti-blocking properties and aggregation during use for a long time at high temperatures and satisfy the low-temperature fixing properties of the toner of the present invention, it is also preferable that the THF-soluble contents of the toner contain 0.5% by weight of components having molecular weights of 1000 or less in the GPC molecular weight distribution.

When the THF-soluble contents of the toner contain over 0.5% by weight of components having molecular weights of 1000 or less, the toner particles easily aggregate due to packing.

Figure 6:
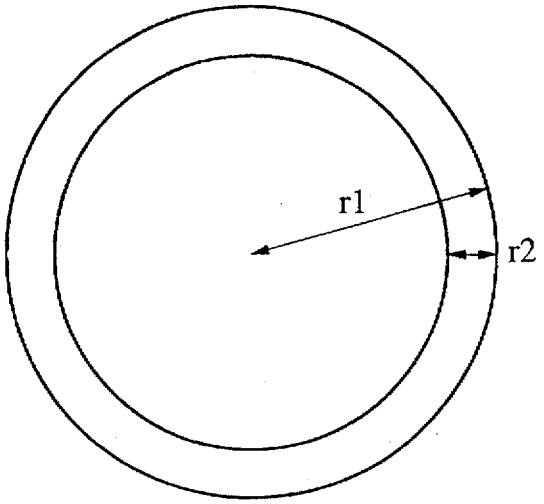
FIG. 6 is a sectional view of a toner having a capsule structure comprising a single core.
Figure 7:
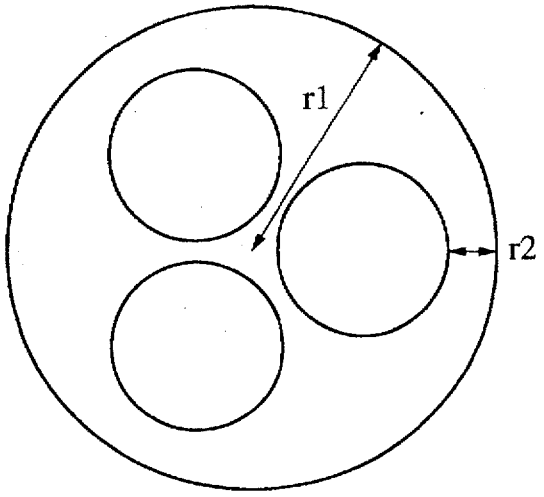
FIG. 7 is a sectional view of a toner having a capsule structure comprising a plurality of core portions.

The toner of the present invention has a capsule structure having a core or nuclear portion and a shell or surface layer which covers the nuclear portion. As the capsule structure, a structure in which a single core is coated with a surface layer, as shown in FIG. 6, or a domain-matrix structure in which a plurality of nuclei are coated with a surface layer may be used.

If the radius of the toner having a capsule structure is r1, and the distance to a single core or a surface of one of a plurality of nuclei which is at the minimum distance from the toner surface is r2, in order to satisfy the aggregation resistance and improve the low-temperature fixing properties, the following relation is preferably satisfied:

$$1.1 \leqq r1/r2 \leqq 100,$$

more preferably the following relation:

$$2.0 \leqq r1/r2 \leqq 50, \text{ and}$$

most preferably the following relation:

$$5.0 \leqq r1/r2 \leqq 40.$$

With a ratio r1/r2 of less than 1.1, sufficient low-temperature fixing properties cannot be obtained, while with a ratio r1/r2 of over 100, aggregation due to packing cannot be sufficiently prevented at high temperatures.

In the present invention, confirmation of the capsule structure and measurement of r1 and r2 are performed by a method in which a toner powder fixed with, for example, an epoxy resin, is sliced by a microtome, dyed with a dye such as osmic acid, and observed by Tunneling Electron Microscopy (TEM) at x 10,000 to 100,000 magnification. A decision as to the structure of the toner is made from the TEM photograph. The magnification is set so that 1 to 2 particles can be observed in the visual field.

In accordance with a preferred embodiment of the present invention, the process for producing the toner is as follows.

The toner is preferably produced by the process comprising the steps of:

dissolving, in a polymerization solvent, a first polymerizable monomer which is soluble in the polymerization solvent and which, by polymerization, produces a polymer insoluble in the polymerization solvent, and a polymer composition, to prepare a polymerization reaction system;

polymerizing the first polymerizable monomer in the presence of a polymerization initiator in the polymerization reaction system with the amount of the dissolved oxygen in the polymerization reaction system set to 2.0 mg/l at the start of polymerization reaction;

when the degree of polymerization of the first polymerizable monomer becomes 50% or more, adding, to the polymerization reaction system, a second polymerizable monomer which is soluble in the polymerization solvent, and which, by polymerization, produces a polymer insoluble in the polymerization solvent and from which a polymer having a higher glass transition temperature than that of the polymer synthesized from the first polymerizable monomer can be synthesized;

polymerizing the second polymerizable monomer in the polymerization reaction system;

recovering polymerization particles from the polymerization reaction system; and producing a toner from the resultant polymerization particles.

In the above production process, the amount of dissolved oxygen in the polymerization reaction system is successively monitored by using a dissolved oxygen meter (produced by Obisfear Laboratories, Dissolved Oxygen Meter Model 3600).

In the present invention, the start of polymerization reaction is defined as the time the conversion degree of polymerization is 5% or less.

The conversion degree of polymerization is measured by calculating a rate of change in the integral value of a monomer peak in gas chromatography (GC) measurement. The measurement method will be described below.

In the present invention, when the toner is produced by the above production process, the amount of the dissolved oxygen in the polymerization reaction system at the start of polymerization reaction is very important for the sharpness of the grain size distribution, the uniformity of the composition, etc. When the amount of dissolved oxygen in the polymerization reaction system at the start of polymerization reaction exceeds 2.0 mg/l, even if the copolymerization component ratio of the binder resin is so set that the glass transition temperature of the toner is set to a value for obtaining desired fixing properties, the polymerization ratio cannot be maintained after polymerization, i.e., the production stability cannot be obtained, and fine particles of 1 μm or less possibly occur in some cases. Therefore, the amount of dissolved oxygen in the polymerization reaction system at the start of polymerization reaction is preferably 2.0 mg/l or less, more preferably 1.0 mg/l or less. The dissolved oxygen is preferably removed by replacing oxygen with an inert gas such as nitrogen, argon or the like, more preferably by blowing an inert gas in the solution to form bubbles. An ultrasonic deoxidation method may be carried out in place of the above gas displacement method or combined with the gas displacement method.

In addition to the control of the amount of dissolved oxygen in the polymerization reaction system, when the conversion degree of polymerization of the first polymerizable monomers becomes 50% or more, the second polymerizable monomer which is soluble in the polymerization solvent in the polymerization reaction system, which produces a polymer insoluble in the polymerization solvent, and from which a polymer having a higher glass transition temperature than that of a polymer synthesized from the first polymerizable monomer can be synthesized is added to the polymerization reaction system to form the surface layer. This feature improves the adhesion between the very soft core inside and the hard surface layer, and causes high uniformity in the surface.

The above production process can also possibly facilitate the prevention of packing at a high temperature without deteriorating the fixing properties. The second polymerizable monomer is more preferably added to the polymerization reaction system when the conversion degree of polymerization of the first polymerizable monomer becomes 60 to 95%. When the second polymerization monomer is added to the polymerization reaction system with a conversion degree of polymerization of less than 50%, the surface layer can be formed in some combinations of the resins of the nuclear portion and the surface layer, but the low-temperature fixing properties generally deteriorate.

Examples of the polymer composition which is dissolved in the polymerization solvent to prepare the polymerization reaction system in the above production process include polystyrene derivatives such as polyhydroxystyrene, polystyrenesulfonic acid, vinylphenol(meth)acrylate copolymers, styrene-vinylphenol(meth)acrylate copolymers, and the like; poly(meth)acrylic derivatives such as poly(meth)acrylic acid, poly(meth)acrylamide, polyacrylonitrile, polyethyl (meth)acrylate, polybutyl (meth)acrylate, and the like; polyvinyl alkyl ether derivatives such as polymethyl vinyl ether, polyethyl vinyl ether, polybutyl vinyl ether, polyisobutyl vinyl ether, and the like; cellulose derivatives such as cellulose, cellulose acetate, cellulose nitrate, hydroxymethyl cellulose, hydroxypropyl cellulose, carboxymethyl cellulose, and the like; polyvinyl acetate derivatives such as polyvinyl alcohol, polyvinyl butyral, polyvinyl formal, polyvinyl acetate, and the like; nitrogen-containing polymer derivatives such as polyvinyl pyridine, polyvinyl pyrrolidone, polyethylene-imine, poly-2-methyl-2-oxazoline, and the like; polyvinyl halide derivatives such as polyvinyl chloride, polyvinylidene chloride, and the like; siloxane derivatives such as polydimethylsiloxane and the like; and copolymers or mixtures thereof.

In order to achieve a uniform grain size distribution, the polymer composition preferably has a weight average molecular weight of 3,000 to 300,000. The weight average molecular weight of the polymer composition can be computed from the molecular weight distribution measured in accordance with the method of measuring the molecular weight of the toner, which will be described below.

When the polymer composition has a weight average molecular weight of less than 3000, the toner has a broad grain size distribution and beyond the range of the present invention. When the weight average molecular weight of over 300,000, the viscosity in the polymerization reaction system is excessively increased during polymerization, and thus uniform agitation is impossible, thereby causing a broad grain size distribution.

In order to obtain a sharp grain size distribution with an average grain size within the range of the present invention, the amount of the polymer composition used is preferably 0.1 to 50% by weight, more preferably 0.5 to 30% by weight, and most preferably 1 to 20% by weight, on the basis of the weight of the polymerization solvent.

When the amount of the polymer composition used is less than 0.1% by weight based on the weight of the polymerization solvent, the produced toner particles cannot be stably maintained in the polymerization reaction system, and thus, in some cases, particles cannot be produced. When the amount of the polymer composition used exceeds 50% by weight, the viscosity in the polymerization reaction system is excessively increased, thereby causing a broad grain size distribution.

Examples of the polymerization solvent used in the production process of the present invention include alcohols such as methanol, ethanol, 1-propanol, 2-propanol, 1-butanol, 2-butanol, isobutyl alcohol, tertbutyl alcohol, 1-pentanol, 2-pentanol, 3-pentanol, 2-methyl-1-butanol, isopentyl alcohol, tert-pentyl alcohol, 1-hexanol, 2-methyl-1-pentanol, 4-methyl-2-pentanol, 2-ethyl butanol, 1-heptanol, 2-heptanol, 3-heptanol, 2-octanol, 2-ethyl-1-hexanol, benzyl alcohol, cyclohexanol, and the like; ether alcohols such as methyl cellosolve, cellosolve, isopropyl cellosolve, butyl cellosolve, diethylene glycol monobutyl ether, and the like; ketones such as acetone, methyl ethyl ketone, methyl isobutyl ketone, cyclohexanone, and the like; esters such as ethyl acetate, butyl acetate, ethyl propionate, cellosolve acetate, and the like; aliphatic or aromatic hydrocarbons such as pentane, 2-methylbutane, n-hexane, cyclohexane, 2-methylpentane, 2,2-dimethylbutane, 2,3-dimethylbutane, heptane, n-octane, isooctane, 2,2,3-trimethylpentane, decane, nonane, cyclopentane, methylcyclopentane, methylcyclohexane, ethylcyclohexane, p-menthane, bicyclohexane, benzene, toluene, xylene, ethylbenzene, and the like; halogenated hydrocarbons such as trichloroethylene, chlorobenzene, tetrabromoethane, and the like; ethers such as ethyl ether, dimethyl ether, trioxane tetrahydrofuran, and the like; acetals such as methylal, diethyl acetal, and the like; fatty acids such as formic acid, acetic acid, propionic acid, and the like; sulfur- or nitrogen-containing organic compounds such as nitropropene, nitrobenzene, dimethylamine, monoethanolamine, pyridine, dimethylformamide, dimethylsulfoxide, and the like; and water.

Examples of the first and second polymerizable monomers used in the production process of the present invention include styrene monomers such as styrene, o-methylstyrene, m-methylstyrene, p-methoxystyrene, p-ethylstryene, p-tert-butylstyrene, and the like; acrylic monomers such as acrylic acid, methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, phenyl acrylate, methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, dimethylaminoethyl methacrylate, diethylaminoethyl methacrylate, benzyl methacrylate, crotonic acid, isocrotonic acid, acid phosphooxyethyl methacrylate, acid phosphooxypropyl methacrylate, acroyl morpholine, 2-hydroxyethyl acrylate, 2-hydroxyethyl methacrylate, acrylonitrile, methacrylonitrile, acrylamide, and the like; vinyl ether monomers such as methyl vinyl ether, ethyl vinyl ether, propyl vinyl ether, n-butyl ether, isobutyl ether, β-chloroethyl vinyl ether, phenyl vinyl ether, p-methyl phenyl ether, p-chlorophenyl ether, p-bromophenyl ether, p-nitrophenyl vinyl ether, p-methoxyphenyl vinyl ether, butadiene, and the like; dibasic acid monomers such as itaconic acid, maleic acid, fumaric acid, monomethyl itaconate, monobutyl itaconate, and the like; heterocyclic monomers such as 2-vinylpyridine, 3-vinylpyridine, 4-vinylpyridine, N-vinylpyrrolidone, 2-vinylimidazole, N-methyl-2-vinylimidazole, N-vinylimidazole, and the like.

These monomers can be used singly or in combination of at least two monomers, and the polymerizable monomers can appropriately be selected so as to obtain a polymer composition suitable for obtaining preferable characteristics.

For the toner of the present invention, it is necessary to use a composition of the polymerizable monomer in which the nuclear portion is different from the composition of the surface layer. For example, it is important that the glass transition temperature of the resin which constitutes the surface layer obtained by polymerizing the second polymerizable monomer added in the course of the production process be higher than the glass transition temperature of the resin which constitutes the nuclear portion obtained by polymerizing the first polymerizable monomer. The difference between the two glass transition temperatures is preferably 20° C. or more.

Specifically, for the binder resin obtained by copolymerizing styrene and n-butyl acrylate, the mixing ratio of styrene and n-butyl acrylate as the first polymerizable monomers is set to 60:40, and the mixing ratio of styrene and n-butyl acrylate added as the second polymerizable monomers when polymerization reaction 50% or more proceeds is set to 61:39 to 100:0, or the mixing ratio of styrene and methyl methacrylate added as the second polymerizable monomers is set to 60:40 to 100:0. In this way, the difference between the two glass transition temperatures can be achieved by changing the composition ratio or the types of the monomers used.

The toner of the present invention may also contain a high molecular weight component or a gel component in the nuclear portion and the surface layer. Such a component is preferably contained in the surface layer. Such a high molecular weight component or gel component can be introduced by using a crosslinking agent having at least two polymerizable double bonds per molecule.

Examples of the crosslinking agent used in the present invention include aromatic divinyl compounds such as divinylbenzene, divinylnaphthalene, and the like; ethylene glycol diacrylate; ethylene glycol dimethacrylate; triethylene glycol dimethacrylate, tetraethylene glycol dimethacrylate, 1,3-butylene glycol dimethacrylate, trimethylolpropane triacrylate, trimethylolpropane trimethacrylate, 1,4-butanediol acrylate, neopentyl glycol diacrylate, 1,6-hexanediol diacrylate, pentaerythritol triacrylate, pentaerythritol tetraacrylate, pentaerythritol dimethacrylate, pentaerythritol tetramethacrylate, glycerol acroxydimethacrylate, N,N-divinylaniline, divinyl ether, divinyl sulfide, divinyl sulfone, and the like. These compounds may be used independently or in appropriate mixture of at least two compounds.

The crosslinking agent can be previously mixed with a polymerizable monomer, but the crosslinking agent is preferably added in the course of polymerization reaction of the polymerizable monomer.

The polymerization particles recovered by the production process of the present invention are preferably subjected to a washing step for removing the polymer composition, unreacted monomers, oligomers, the initiator and other additives which remain in the polymerization reaction system.

In the washing step, the particles can be washed by a washing method comprising, for example, repeated decantation, centrifugation, pressure filtration, filtration under reduced pressure, or the like, and ultrasonic agitation, mechanical agitation or the like.

After washing, the toner is dried and then used. However, the drying step is not limited, the toner can be dried by any conventional drying method.

The toner of the present invention may be classified after drying if required.

In the present invention, any known colorant can be used. The toner can be colored with the colorant by any method such as the method of adding the colorant to the polymerization reaction system together with a polymerizable monomer to contain the colorant in the toner at the same time as polymerization, the method of dyeing with a dye in a hot-solvent after the polymerization particles are obtained, etc. However, in the present invention, a coloring method is undesirable in which after the polymerization particles are produced, the colorant is pressure adhered to the toner surfaces while applying a mechanical impact. If particles of the colorant having hygroscopicity are present on the toner surfaces, aggregation readily occurs due to nonuniformity in fine portions.

Examples of the colorant used in the present invention include carbon black and known organic colorants; dyes such as C. I. Basic Red 1, C. I. Mordant Red 30, C. I. Direct Blue 1, C. I. Direct Blue 2, C. I. Acid Blue 15, C. I. Basic Blue 3, C. I. Basic Blue 5, C. I. Mordant Blue 7, C. I. Direct Green 6, C. I. Basic Green 4, C. I. Basic Green 6, and the like; pigments such as cadmium yellow, mineral fast yellow, navel yellow, naphthol yellow S, Hansa yellow G, permanent yellow NCG, tartrazine lake, molybdenum orange GTR, benzidine orange G, cadmium red 4R, Watchung red calcium salt, brilliant carmine 3B, fast violet B, methyl violet lake, cobalt blue, alkali blue lake, victoria blue lake, quinacridone, rhodamine lake, phthalocyanine blue, fast sky blue, pigment green B, malachite green lake, final yellow green G, and the like; C. I. Solvent Yellow; C. I. Solvent Yellow 9; C. I. Solvent Yellow 17, C. I. Solvent Yellow 31; C. I. Solvent Yellow 35; C. I. Solvent Yellow 100; C. I. Solvent Yellow 102; C. I. Solvent Yellow 103; C. I. Solvent Yellow 105; C. I. Solvent Orange 2; C. I. Solvent Orange 7; C. I. Solvent Orange 13; C. I. Solvent Orange 14; C. I. Solvent Orange 66, C. I. Solvent Red 5, C. I. Solvent Red 16, C. I. Solvent Red 17, C. I. Solvent Red 18, C. I. Solvent Red 19, C. I. Solvent Red 22, C. I. Solvent Red 23, C. I. Solvent Red 143, C. I. Solvent Red 145, C. I. Solvent Red 146, C. I. Solvent Red 149, C. I. Solvent Red 150, C. I. Solvent Red 151, C. I. Solvent Red 157, C. I. Solvent Red 158, C. I. Solvent Violet 31, C. I. Solvent Violet 32, C. I. Solvent Violet 33, C. I. Solvent Violet 37, C. I. Solvent Blue 22, C. I. Solvent Blue 63, C. I. Solvent Blue 78, C. I. Solvent Blue 83, C. I. Solvent Blue 84, C. I. Solvent Blue 85, C. I. Solvent Blue 86, C. I. Solvent Blue 104, C. I. Solvent Blue 191, C. I. Solvent Blue 194, C. I. Solvent Blue 195, C. I. Solvent Green 24, C. I. Solvent Green 25, C. I. Solvent Brown 3, C. I. Solvent Brown 9, and the like. Examples of commercial dyes include Diaresin Yellow-3G, Yellow-F, Yellow-H2G, Yellow-HG, Yellow-HC, Yellow-HL, Orange-HS, Orange-G, Red-GG, Red-S, Red-HS, Red-A, Red-K, Red-H5B, Violet-D, Blue-J, Blue-G, Blue-N, Blue-K, Blue-P, Blue-H3G, Blue-4G, Green-C, and Brown-A, which are produced by Mitsubishi Kasei Co., Ltd.; SOT Dyes Yellow-1, Yellow-3, Yellow-4, Orange-1, Orange-2, Orange-3, Scarlet-1, Red-1, Red-2, Red-3, Brown-2, Blue-1, Blue-2, Violet-1, Green-1, Green-2, Green-3, Black-1, Black-4, Black-6, and Black-8, which are produced by Hodogaya Chemical Co., Ltd.; Sudan dyes Yellow-146, Yellow-150, Orange-220. Red-290, Red-380, Red-460 and Blue-670, which are produced by BASF Co., Ltd.; Oil Black and Oil Color Yellow-3G, Yellow-GG-S, Yellow-#105, Orange-PS, Orange-PR.

Orange-#201, Scarlet#308, Red-5B, Brown-GR, Brown-#416, Green-BG, Green-#502, Blue-BOS, Blue-IIN, Black-HBB, Black-#803, Black-EB, and Black-EX, which are produced by Orient Chemical Industry Co., Ltd.; Sumiplast Blue-GP, Blue-OR, Red-FB, Red-3B, Yellow-FL7G, and Yellow-GC, which are produced by Sumitomo Chemical Co., Ltd.; Kayaron Polyester Black EX-SF-300, Kayaset Red B, and Blue A-2R which are produced by Nippon Kayaku Co.,Ltd.

In the fine particle toner of the present invention, the amount of the colorant used is preferably 0.1 to 15 parts by weight, more preferably 1.0 to 10 parts by weight, and most preferably 2 to 8 parts by weight, relative to 100 parts by weight of binder resin of the toner.

When the content of the dye or pigment is less than 0.1 part by weight relative to 100 parts by weight of binder of the toner, the toner lacks hiding or covering power. When the content exceeds 15 parts by weight, OHP transparency deteriorates according to the type of the colorant used.

In the present invention, a magnetic toner can be prepared by using a magnetic material as the colorant. In this case, the amount of the magnetic material used is preferably 5 times the content of the dye or pigment because the specific gravity of the magnetic material is about 5 g/cm$^3$, while the specific gravity of the dye or pigment is about 1 g/cm$^3$.

As the polymerization initiator used in the present invention, any known conventional initiator can be used. A radical polymerization initiator or ionic polymerization initiator can be used as the polymerization initiator.

Examples of such radical polymerization initiators include azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-(2-methylbutyronitrile), 2,2'-azobis-4-methoxy-2,4-dimethylvaleronitrile, and the like; amidine compounds such as 2,2'-azobis(N,N'-dimethyleneisobutylamidine), 2,2'-azobis(N,N'-dimethyleneisobutylamidine) dihydrochloride, and the like; peroxide compound initiators such as benzoyl peroxide, methyl ethyl ketone peroxide, diisopropyl peroxycarbonate, cumene hydroperoxide, 2,4-dichlorobenzoyl peroxide, lauroyl peroxide, and the like; persulfate initiators such as potassium persulfate, ammonium persulfate, and the like.

Examples of anionic polymerization initiators include strong alkalis such as $SrR_2$, $CaR_2$, K, KR, Na, NaR, Li, LiR, R-MgR, R-ONa, R-OK, R-OLi, sodium hydroxide, potassium hydroxide, and the like; weak alkalis such as pyridine, ammonia, and the like; R—O—R (wherein R is an alkyl group); and water.

Examples of cationic polymerization initiators include $SnCl_4$, $BF_3$, $AlCl_3$, $TiCl_3$, and the like. These polymerization initiators can be used independently or in combination of at least two compounds.

The concentration of the polymerization initiator used for producing the toner of the present invention can be appropriately adjusted in consideration of the molecular weight of the polymer produced, and the yield. The concentration of the polymerization initiator is preferably 0.1 to 15% by weight, and more preferably 0.5 to 12% by weight, on the basis of the total amount of the polymerizable monomer used.

With less than 0.1% by weight of polymerization initiator, it is difficult to sufficiently generate radicals, and thus polymerization does not proceed in some cases. With over 15% by weight of polymerization initiator, since many radicals are generated, the molecular weight is not increased, and the resin obtained has a low glass transition temperature depending upon the polymerizable monomer used.

In the above production process of the present invention, the polymerization reaction can be effected by adding a chain transfer agent.

Examples of such chain transfer agents include halogenated hydrocarbons such as ethyl oxybromoacetate, dibromoethylbenzene, dibromoethane, dichloroethane, and the like; hydrocarbons such as diazothioether, benzene, ethylbenzene, isopropylbenzene, and the like; mercaptans such as tert-dodecyl mercaptan, n-dodecyl mercaptan, and the like; disulfides such as diisopropylxanthogen disulfide, and the like.

The toner of the present invention can contain a charge control agent for controlling chargeability. As the charge control agent, a positive charge control agent or negative charge control agent which is generally used for toners can be used. Examples of charge control agents include nigrosine dyes, triphenylmethane dyes, tertiary ammonium salts, amine or imine compounds, metal compounds of salicylic acid or alkyl salicylic acid, metal-containing monoazo dyes, carboxyl- or sulfoxyl-containing compounds, humic acid and humin salts such as nitrohumin.

In the present invention, the toner having a capsule structure having a single nuclear portion can be most preferably produced by the above-mentioned polymerization process for producing the toner.

The toner having a domain-matrix capsule structure having a plurality of nuclei can be efficiently obtained by using the production process below.

Namely, the production process employs a porous glass film emulsion method.

First, binder resin A which has a desired molecular weight distribution and a low glass transition temperature is dissolved in an effective solvent such as toluene or the like. The resultant solution is then pored into a poor solvent such as methanol, ethanol or the like to re-precipitate the binder resin from which low-molecular weight components and residual monomer are removed. The thus-obtained binder resin is again dissolved in an effective solvent to prepare resin solution A having low Tg. The low-Tg resin solution A is then passed through a first phase-splitting glass porous material of a tubular shape having uniform fine pores, and dispersed directly in an aqueous solution (first continuous phase) containing a surfactant to prepare an oil/water (O/W) emulsion.

Next, binder resin B having a desired molecular weight distribution and a high glass transition temperature is dissolved in an effective solvent such as toluene. The resultant solution is then poured into a poor solvent such as methanol, ethanol or the like to re-precipitate the binder resin from which low-molecular-weight components and residual monomer are removed. The thus-obtained binder resin is again dissolved in an effective solvent to prepare high-Tg resin solution B. A polymerizable monomer, a crosslinkable monomer and a polymerization initiator are dissolved in the high-Tg solution B to prepare a second continuous phase. The O/W emulsion is passed through a second phase splitting glass porous material subjected to hydrophobic treatment and having larger fine pores than those of the first phase spitting glass porous material, and then dispersed directly in the second continuous phase to prepare an oil/water/oil (O/W/O) emulsion.

Thirdly, the thus-prepared O/W/O emulsion is passed through a third phase splitting glass porous material having larger fine pores than those of the second phase spitting glass porous material, and dispersed in an aqueous solution (third continuous phase) containing a surfactant to prepare an oil/water/oil/water (O/W/O/W) emulsion.

Fourthly, in this state, polymerization is effected, and a powder is recovered from the resultant slurry, and then dried to obtain a toner having a domain-matrix capsule structure.

The toner of the present invention may contain various external additives which are externally added thereto for the purpose of improving the fluidity and chargeability thereof. Examples of such external additives include fine powders such as silica, titanium oxide, alumina and the like. An external additive which is preferably used for the toner of the present invention has a BET specific surface area of 300 $m^2/g$ or more. Although an additive having a BET specific surface area of less than 300 $m^2/g$ can also be used, an external additive having a specific surface area of 300 $m^2/g$ or more is preferable for (i) maintaining the uniform surface state of the toner having a fine particle size and a sharp grain size distribution, (ii) improving chargeability, (iii) preventing embedding of the external additive during use for a long time, and (iv) achieving long-term stability of an image. Particularly, when the external additive having a specific surface area of 350 $m^2/g$ or more is used together with the fine particle toner, the stability, fluidity and chargeability can be more stably maintained during use for a long period of time.

The present invention can be applied to a one-component developer or a two-component developer containing carrier particles mixed with the toner. As the carrier, conventional carriers such as iron powders, magnetite, ferrite, magnetic material-dispersed resin carriers and the like can be used. The number average particle size of the toner is preferably 30 μm or less in order to sufficiently apply charge to the toner.

The method of measuring each of the physical properties will be described below.

(1) Extraction of soluble resin components of toner with solvent mixture

The soluble resin components are extracted by the extractor shown in FIG. 1 in an environment of room temperature and normal humidity.

10 parts of toner powder 1 are precisely weighed, and placed in a cylindrical filter 2 having an inner diameter B of 24 mm, and the cylindrical filter 2 is covered with a circular filter 3 having the same diameter of the inner diameter of the cylindrical filter 2. The cylindrical filter 2 is set in an extraction tube 4 having an inner diameter A of 33 mm.

A solvent mixture 10 of ethanol (EtOH) and methyl ethyl ketone (MEK) (2:1) contained in a measuring cylinder 9 is added dropwise by using a feeding pump 11. At the same time, a cock 6 of the extraction tube 4 is closed, and the extraction tube 4 is filled with the solvent mixture 10 so that the toner powder 1 in the cylindrical filter 2 is uniformly wetted, and the liquid surface 5 is 5 mm higher than the circular filter 3 placed on the toner powder 1 in the cylindrical filter 2. As the feeding pump 11, digital pump 7524-10 (produced by Master Flex Co., Ltd.) is used, and a pump head 32S (produced by Master Flex Co., Ltd.) 12 and silicon tube 32SL (produced by Master Flex Co., Ltd.) 13 are combined with the pump. The digital pump is capable of adding dropwise the mixture solvent 10 at a constant amount per unit time into the extraction tube 4 from the silicon tube 13. The amount of the solvent mixture 10 added can be appropriately adjusted.

In this state, the cock 6 of the extraction tube 4 is immediately opened to add dropwise the extract 8 to a first container 7 from the extraction tube 4, and the feeding pump 11 is operated to add dropwise the solvent mixture 10 from the measuring cylinder 9. At this time, the feeding pump 11 is adjusted so that the amount of the extract 8 added dropwise from the extraction tube 4 is equal to the amount of the solvent mixture 10 added dropwise from the measuring cylinder 9, thereby creating the state wherein a constant amount of solvent mixture 10 is always present in the extraction tube 4, i.e., keeping the liquid surface 5 in the extraction tube 4 constant. This causes the extract (solvent-mixture-soluble resin component) 8 which is successively dissolved and extracted from the surfaces of the toner particles to accumulate in the first container 7.

The amount of the extract 8 added dropwise from the extraction tube 4 and the amount of the solvent mixture 10 added dropwise from the measuring cylinder 9 are, for example, 12 ml/min.

When the weight of the solvent mixture soluble resin component of the extract 8 accumulated in the first container 7 from the start of extraction is 10% by weight of the total weight of the solvent mixture soluble resin components of a sample, the cock 6 of the extraction tube 4 is closed, the feeding pump 11 is stopped, dropwise addition of the solvent mixture from the measuring cylinder 9 is stopped, and the first container 7 is changed to a second container. At this time, the extract 8 accumulated in the first container 7 is considered as a first extract.

Next, the cock 6 of the extraction tube 4 is again opened to add dropwise the extract to the second container from the extraction tube 4, and the feeding pump 11 is operated to again add dropwise the solvent mixture 10 from the measuring cylinder 9. At this time, both the amount of the extract added dropwise from the extraction tube 4 and the amount of the solvent mixture 10 added dropwise from the measuring cylinder 9 by the feeding pump 11 are adjusted to the same value (for example, 12 ml/min.) as that in extraction of the first extract. Extraction is continued until the solvent mixture soluble resin components of the sample are completely extracted (end of extraction). The extract accumulated in the second container is considered as a second extract.

The solvents are distilled off from the thus-obtained first extract under reduced pressure, and the glass transition temperature (Tg1) of the extract powder (first soluble resin component) is measured.

The solvents are distilled off from the thus-obtained second extract under reduced pressure, and the glass transition temperature (Tg1) of the extract powder (second soluble resin component) is measured.

The time when the weight of the solvent mixture soluble resin component of the extract 8 accumulated in the first container 7 from the start of extract is 10% by weight of the total weight of the solvent-mixture-soluble resin components of the sample, and the time when the solvent-mixture-soluble resin components are completely extracted are determined by using a calibration curve according to the amount of the solvent mixture added dropwise. This calibration curve indicates the relation between the amount of the solvent mixture added dropwise and the amount of the dissolved solvent-mixture-soluble resin component of the sample and has previously been formed by a pre-test. The pre-test for forming the calibration curve is carried out immediately before the main test for extracting the solvent-mixture-soluble resin components from the sample, and environmental conditions of the pre-test must be matched to those of the main test.

(2) Measurement of glass transition temperature

Figure 2:
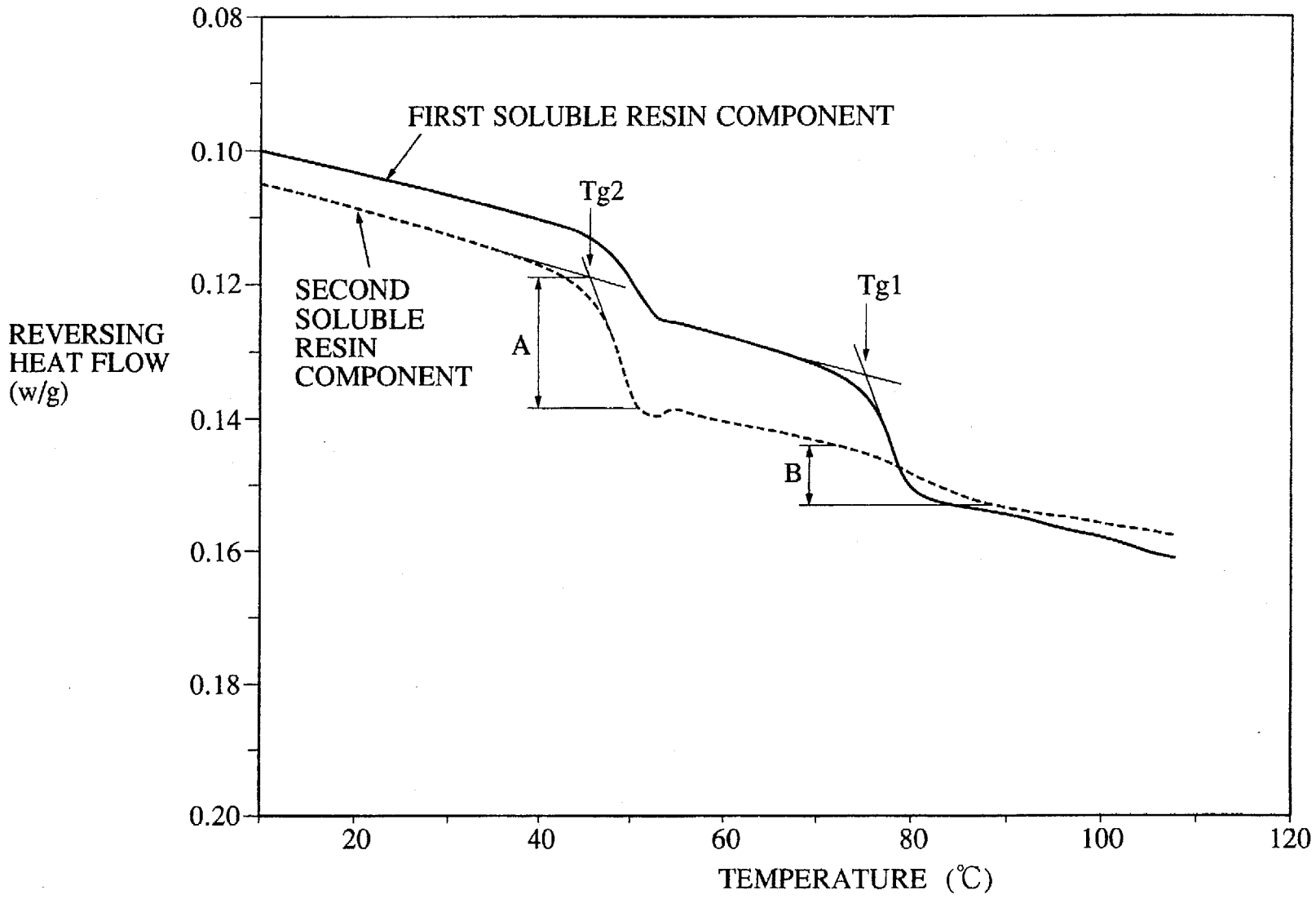
FIG. 2 is a graph showing the DSC curves of a first soluble resin component and a second soluble resin component of a toner.
Figure 3:
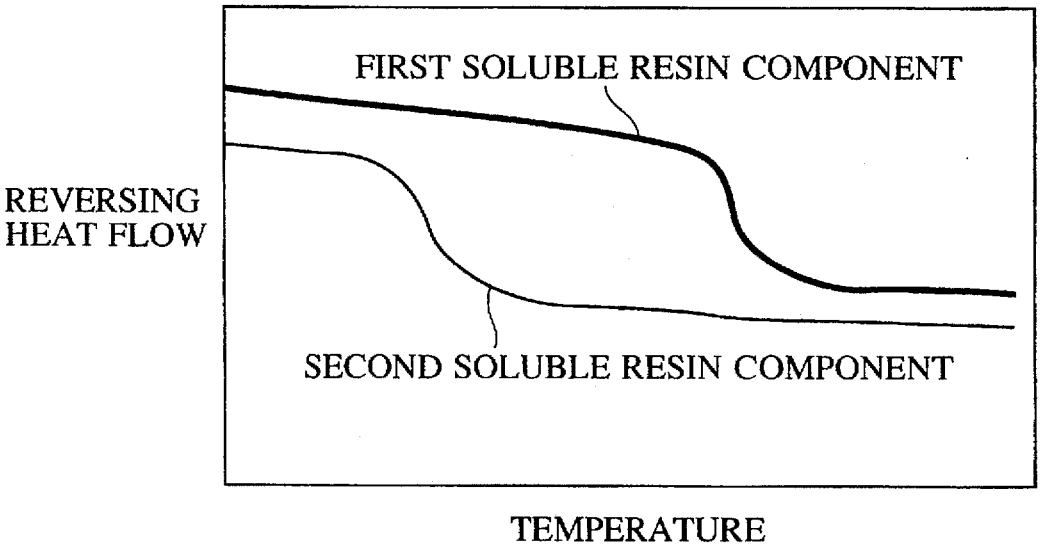
FIG. 3 is a graph showing DSC curves when each of a first soluble resin component and a second soluble resin component of a toner has one glass transition temperature.
Figure 4:
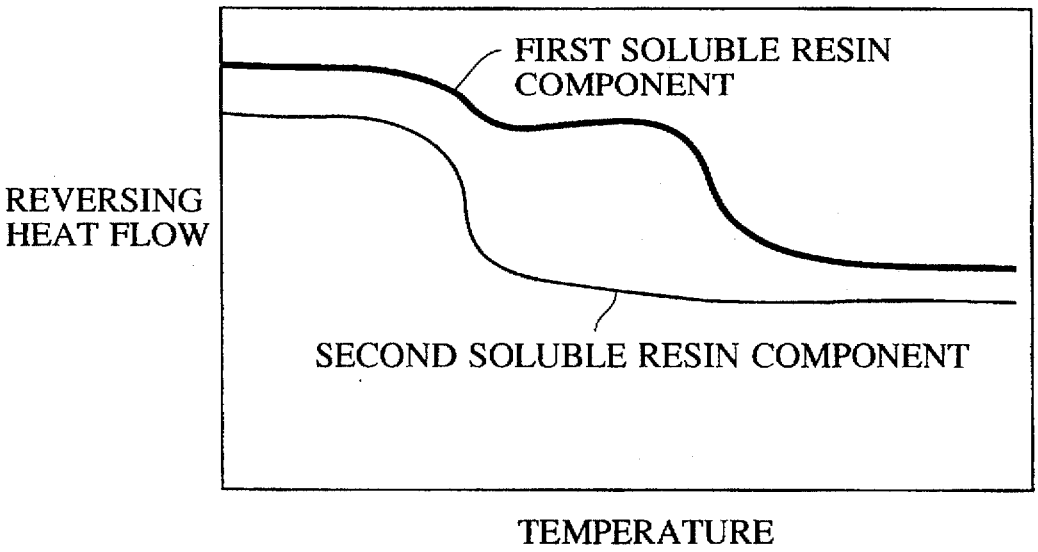
FIG. 4 is a graph showing DSC curves when a first soluble resin component of a toner has two glass transition temperatures, and a second soluble resin component has one glass transition temperature.
Figure 5:
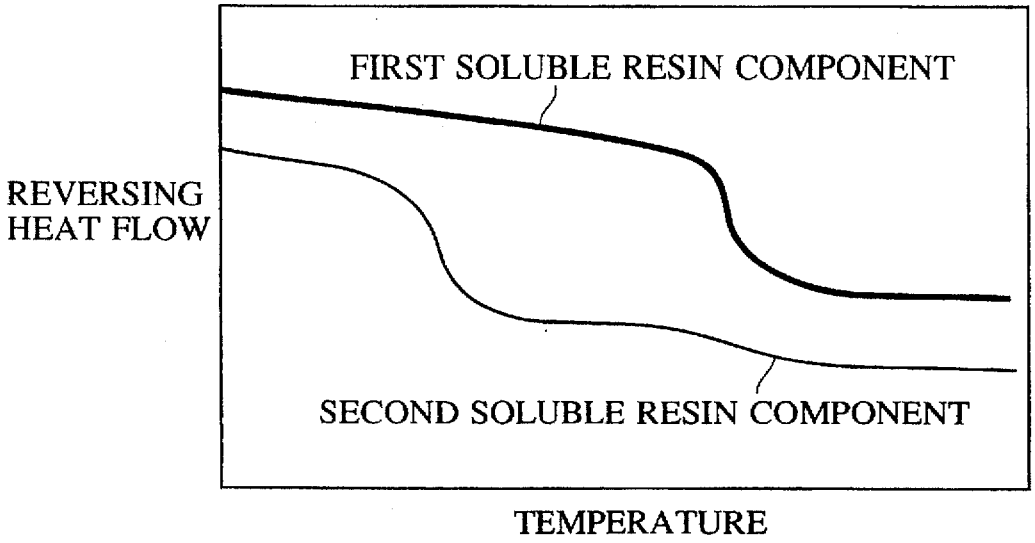
FIG. 5 is a graph showing DSC curves when a first soluble resin component of a toner has one glass transition temperature, and a second soluble resin component has two glass transition temperatures.

The glass transition temperature of the soluble resin component is measured by using a DSC measurement device (M-DSC produced by TA-Instrument Co., Ltd.). 6 mg of test sample is precisely weighed. This test sample is placed in an aluminum pan, and then measured at room temperature and normal humidity within the measurement temperature range of 20° to 200° C. at a rate of temperature rise of 4° C./min. using an empty aluminum pan as a reference. In this measurement, the modulation amplitude is ±0.6° C., and the frequency is 1 /min. The maximum glass transition temperatures (Tg1, Tg2) are calculated from the reversing heat flow curve obtained. The intersection of the tangent lines of the base line and the endothermic curve is considered as the glass transition temperature. In this case, when a plurality of endothermic curves are present, the glass transition temperature of a portion showing the maximum endothermic width is considered as the maximum glass transition temperature. FIG. 2 schematically shows an example of DSC measurement. In FIG. 2, the reversing heat flow curve of the first soluble resin component is shown by a solid line, and the reversing heat flow curve of the second soluble resin component is shown by a broken line. Both curves have two glass transition temperatures. Referring to the endothermic curve shown by the broken line, endotherm (A) on the low-temperature side is greater than endotherm (B) on the high-temperature side, and thus, in the curve shown by the broken line, the glass transition temperature of the portion of endotherm (A) is considered as the maximum glass transition temperature (Tg2). For the curve shown by the solid line, the maximum glass transition temperature Tg1 is determined in the same manner, as shown in FIG. 2.

(3) Measurement of molecular weight distribution of toner

The molecular weight distribution of the toner is measured by using a GPC measurement device (HLC-8120GPC produced by Toso Co., Ltd.) under the following measurement conditions:

Measurement conditions

Column: two columns of TSK gel HM-M (6.0*15 cm)

Temperature: 40° C.

Solvent: THF

Detector: RI

Sample concentration: 10 μl of 0.1% sample

A sample is added to tetrahydrofuran (THF), allowed to stand for several hours, and then sufficiently shaken (until no aggregate of the sample is observed). After the sample is further allowed to stand for 12 hours, the sample is passed through a sample processing filter (pore size 0.45 μm) to obtain a GPC sample.

As the calibration curve, the molecular weight calibration curve formed by using monodisperse polystyrene as a standard sample is used. The maximum molecular weight is determined from the logarithmic curve (log M) obtained. The components having very low molecular weights and contained in the THF soluble component of the toner are calculated from the cumulative curve of components having molecular weights of 1000 or less. In the present invention, the molecular weight is determined from the molecular weight distribution by weight.

(4) Measurement of particle size of toner particles

The particle size of the toner particles used in the present invention is measured by using a laser scanning type grain size distribution measurement device (CIS-100 produced by GALAI Co., Ltd.) within the range of 0.4 to 60 μm. 0.5 to 2 mg of toner is added to a solution of 100 ml of water to which 0.2 ml of surfactant (alkylbenzenesulfonate) is added, and then dispersed by an ultrasonic dispersion device for 2 minutes. Water is added to about 80% of a cubic cell with a magnetic stirrer, and few drops of the sample ultrasonically dispersed are added to the cubic cell. The number average particle size and the coefficient of variation are determined on the basis of the number average particle size Dn and the standard deviation S.D. In this measurement, the toner showing a number average particle size of 1 μm or less is subjected to the measurement of the number average particle size below. The number average particle size obtained by the measurement below is considered as the number average particle size of the toner.

The toner is photographed at 5000 x magnification by using a scanning type electron microscope (FE-SEMS-800 produced by Hitachi, Ltd.). On the basis of the photograph, the Feret's diameter of particles of 0.05 μm or more are measured until the cumulative number becomes 300 or more. The average of the diameters is considered as the number average particle size. The coefficient of variation is determined by the same equation as SIC-100 using the number average particle size.

(5) Measurement of frictional charge of toner

When a developer is formed from a toner and a carrier, the toner and carrier are mixed in an appropriate mixing amount (2 to 15% by weight), and then mixed by a tubular mixer for 180 seconds. Thus-mixed power is placed in a metallic container having a 635-mesh conductive screen mounted on the bottom thereof, and then evacuated by an aspirator. The frictional charge is determined from the difference between the weights before and after suction, and the potential accumulated in a capacitor connected to the container. In this measurement, the suction force is 250 mmHg. In this method, the frictional charge is calculated by the following equation:

$$Q(\mu C/g)=(C\times V)/(W1-W2)$$

wherein W1 is the weight before suction, W2 is the weight after suction, C is the capacity of the capacitor, and V is the potential accumulated in the capacitor.

The toner of the present invention has a fine particle size, a sharp particle size distribution, and has a capsule structure in which the resin of the toner surface layer has a higher glass transition temperature than that of the resin of the inner nuclear portion. It is thus possible to achieve high image quality, and provide a toner having excellent low-temperature fixing properties without causing aggregation even in packing in an environment of high temperature.

Although the present invention will be described with reference to examples, the present invention is not limited to these examples. In the examples, "parts" represents "parts by weight".

EXAMPLES

Example 1

| | |
|---|---|
| Methanol | 600 parts |
| Polyvinyl pyrrolidone | 60 parts |
| Styrene | 65 parts |
| n-butyl acrylate | 35 parts |
| Carbon black | 5 parts |
| Di-t-butylsalicylic acid metal compound | 1 part |
| 2,2'-azobis-(2-methylbutyronitrile) | 8.5 parts |

A mixture of the above materials was poured into a reactor provided with a reflux condenser, a thermometer, a nitrogen inlet tube, and a mechanical stirrer, and the mixed solution was sufficiently mixed under bubbling by blowing in nitrogen at 400 ml/min for 30 minutes. The amount of the dissolved oxygen measured at the start of polymerization was 0.8 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 30 parts of styrene and 2 parts of n-butyl acrylate was added to the reactor at a rate of 10 parts per minute. A polymerization reaction was then effected for 12 hours in an atmosphere of nitrogen.

After the polymerization reaction was completed, the reactor was cooled to room temperature, and then methanol washing and decantation of the reaction dispersion were repeated 5 times. The thus-obtained slurry was dried to recover toner particles having a number average particle size (Dn) of 3.73 μm and a number distribution having a coefficient of variation of 11%.

The thus-obtained toner particles were extracted for 2 hours (the amount of the solvent mixture added dropwise: 1440 ml) with a solvent mixture of ethanol (EtOH) and methyl ethyl ketone (2:1) by using the modified Soxhlet extractor shown in FIG. 1. As a result of DSC measurement of the maximum glass transition temperature (Tg1) of the first soluble resin component obtained until 10% by weight of the total amount of the solvent-mixture-soluble resin components was extracted from the start of extraction, the maximum glass transition temperature Tg1 was 76.2° C. As a result of DSC measurement of the maximum glass transition temperature (Tg2) of the second soluble resin component of the remainder, Tg2 was 45.0° C.

The thus-obtained toner particles were fixed with epoxy, and then sliced by a microtome to produce a super-thin slice which was then dyed with osmic acid. As a result of TEM observation of this slice at 15,000 x magnification, a two-layer structure comprising a nuclear portion and a surface or shell layer was observed. The toner radius r1 and the average minimum distance r2 from the surface to the core were determined from density differences of the dye. As a result, the ratio r1/r2 was 13.8.

As a result of measurement of the molecular weight of the toner, Mp of the molecular weight distribution was 20,500, and the content of components having molecular weights of 1,000 or less was 0.35% by weight of the toner particles.

2.0 parts of hydrophobic silica fine powder having a BET value of 360 $m^2$ was externally added to 100 parts by weight of the thus-obtained toner by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −35.1 μC/g.

The two-component developer was placed in a modified machine of full color laser copier copying machine CLC-500 produced by Canon Inc. in which the developer carrier of the developing unit was matted to a surface roughness Rz of 10. In order to precisely evaluate the toner-reproducibility of a halftone image, the diameter of a normal laser spot was reduced by 20%. A solid image and a halftone image were formed and then evaluated.

The solid image was formed in a strip having a width of 2 cm and a length of 10 cm to obtain an unfixed solid image on plain paper. The unfixed image was tested with respect to fixing by using an external fixing unit having the same fixing unit construction as CLC-500. In the fixing test, the plain paper on which the strip-formed unfixed solid image was formed was passed through the external fixing unit in the direction of the length of the strip while monitoring the temperature of the upper roller of the external fixing unit. The lowest temperature when no offset was observed at the tail end of the strip was considered as the fixing start temperature. As a result, the fixing start temperature was 125° C. As a result of measurement of the image density of the fixed solid image by a Macbeth reflection densitometer, the image density was 1.52.

The toner-reproducibility of the halftone image formed by micro spots was evaluated by a method in which the toner-reproducibility of micro spots formed in one pixel by laser pulse width modulation (PWM) multivalue recording was evaluated by microscopic observation of the surface of the photosensitive drum. The evaluation was made on the basis of the following criteria:

A: The micro-dots were developed with very good reproducibility without dot distortion.

B: The micro-dots were developed with good reproducibility without scattering, but slight variation occurred in dot shape C: Scattering and variations in dot shape occurred, but no practical problem occurred.

D: Scattering and variations in dot shape significantly occurred.

E: Dots were not developed faithfully, and scattering significantly occurred.

As a result, the reproducibility of the halftone image was very good.

After the toner was allowed to stand at high temperature and high humidity (30° C., 80 RH%) for 7 days, aggregation and the reproducibility of a halftone image were evaluated after the toner was allowed to stand.

Aggregation was evaluated by a method in which 3 g of toner is placed in a 50-cc glass container, and then allowed to stand at high temperature and high humidity for 7 days. Evaluation was made on the basis of the following criteria:

A: The toner assumed a very good free-flowing state without packing.

B: Partial packing occurred, but good free-flowing state was caused after shaking.

C: Packing occurred, but good free-flowing state without practical problem was caused after shaking.

D: Packing and slight aggregation undesirably occurred.

E: Aggregation was not removed, and lumps were observed.

As a result, the toner after being allowed to stand at high temperature and high humidity was very excellent in fluidity.

After the toner was allowed to stand at high temperature and high humidity, the toner-reproducibility of a halftone image was evaluated by a method in which the toner after being allowed to stand was mixed with the same carrier as that used for preparing the above two-component developer to prepare a two-component developer, and then a halftone image was formed by a modified machine of CLC-500 in the same manner as the above image evaluation, and then evaluated.

As a result, the toner-reproducibility of the halftone image was very good in the same manner as the initial state. Table 1 shows the physical properties of the toner, and Table 2 shows the results of evaluation.

Example 2

| | |
|---|---|
| Methanol | 600 parts |
| Polyvinyl pyrrolidone | 40 parts |
| Styrene | 65 parts |
| n-butyl acrylate | 35 parts |
| Carbon black | 5 parts |
| Di-t-butylsalicylic acid metal compound | 1 part |
| 2,2'-azobis-(2-methylbutyronitrile) | 10.2 parts |

A mixture of the above materials was poured into a reactor provided with a reflux condenser, a thermometer, a nitrogen inlet tube, and a mechanical stirrer, and the mixed solution was sufficiently mixed under bubbling by blowing nitrogen at 400 ml/min for 20 minutes in the same manner as Example 1. The amount of the dissolved oxygen measured at the start of polymerization was 1.1 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 30 parts of styrene and 2 parts of n-butyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.82 μm and a number distribution having a coefficient of variation of 15.9%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 74.4° C. and Tg2 was 46.3° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus (or core) were determined from the density difference of the dye. As a result, the ratio r1/r2 was 15.1.

As a result of measurement of the molecular weight of the toner particles, Mp of the molecular weight distribution was 18100, and the content of components having molecular weights of 1000 or less was 0.40% by weight of the toner particles.

1.0 part of hydrophobic silica fine powder having a BET value of 360 $m^2$ was externally added to the thus-obtained toner particles by mixing with a Henschel mixer.

10% by weight of toner and 90% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −27.8 μC/g.

A solid image and a halftone image were formed by using this two-component developer in the same manner as Example 1. The fixing start temperature, the solid image density, the toner-reproducibility of a halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 3

| | |
|---|---|
| Methanol | 600 parts |
| Polyvinyl pyrrolidone | 100 parts |
| Styrene | 65 parts |
| n-butyl acrylate | 35 parts |
| Carbon black | 5 parts |
| Di-t-butylsalicylic acid metal compound | 1 part |
| 2,2'-azobis-(2-methylbutyronitrile) | 7.0 parts |

A mixture of the above materials was poured into a reactor provided with a reflux condenser, a thermometer, a nitrogen inlet tube, and a mechanical stirrer, and the mixed solution was sufficiently mixed under bubbling by blowing nitrogen at 400 ml/min for 25 minutes in the same manner as Example 1. The amount of the dissolved oxygen measured at the start of polymerization was 1.0 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 30 parts of styrene and 2 parts of n-butyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 1.40 μm and a number distribution having a coefficient of variation of 13.9%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 77.7° C. and Tg2 was 47.8° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 14.1.

As a result of measurement of the molecular weight of the toner particles, Mp of the molecular weight distribution was 26800, and the content of components having molecular weights of 1000 or less was 0.21% by weight of the toner particles.

2.5 parts of hydrophobic silica fine powder having a BET value of 360 $m^2$ was externally added to 100 parts of the thus-obtained toner particles by mixing with a Henschel mixer.

3.5% by weight of toner and 96.5% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −43.9 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 4

| | |
|---|---|
| Methanol | 600 parts |
| Polymethyl vinyl ether | 100 parts |
| Styrene | 60 parts |
| n-butyl acrylate | 40 parts |
| Carbon black | 5 parts |
| Di-t-butylsalicylic acid metal compound | 1 part |
| 2,2'-azobis-(2-methylbutyronitrile) | 9.6 parts |

A mixture of the above materials was poured into a reactor with a reflux condenser, a thermometer, a nitrogen inlet tube, and a mechanical stirrer, and the mixed solution was sufficiently mixed under bubbling by blowing nitrogen at 400 ml/min for 30 minutes in the same manner as Example 1. The amount of the dissolved oxygen measured at the start of polymerization was 1.0 mg/l. Polymerization reaction was then effected at a nitrogen flow rate of 40 ml/l and an oil bath temperature of 65° C. while monitoring the consumption of styrene by GC. When the consumption of styrene reached 90%, 40 parts of styrene was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.56 μm and a number distribution having a coefficient of variation of 14.5%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 92.1° C. and Tg2 was 34.0° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 5.93.

As a result of measurement of the molecular weight of the toner particles, Mp of the molecular weight distribution was 21600, and the content of components having molecular weights of 1000 or less was 0.32% by weight of the toner particles.

2.5 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −36.8 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 5

A mixture prepared by the same method as Example 4 was poured into the same reactor as Example 4, and the mixed solution was sufficiently mixed under bubbling by blowing nitrogen at 400 ml/min for 30 minutes. The amount of the dissolved oxygen measured at the start of polymerization was 1.0 mg/l. Polymerization reaction was then effected at a nitrogen flow rate of 40 ml/l and an oil bath temperature of 65° C. while monitoring the consumption of styrene by GC. When the consumption of styrene reached 90%, a mixture of 32 parts of styrene and 8 parts of 2-ethylhexyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.40 μm and a number distribution having a coefficient of variation of 17.0%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 67.0° C. and Tg2 was 35.0° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 5.99.

As a result of measurement of the molecular weight of the toner particles, Mp of the molecular weight distribution was 21100, and the content of components having molecular weights of 1000 or less was 0.38% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −35.0 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 6

Styrene-butyl acrylate copolymer (monomer composition ratio by weight: 65:36, molecular weight Mp 25000) was dissolved in toluene to obtain a 20% solution, and undissolved components were filtered off to prepare a solution. The thus-prepared solution was added dropwise at a rate of 10 ml/min to methanol under agitation, and the precipitate was recovered, sufficiently dried under reduced pressure, and then re-precipitated to obtain a styrene-butyl acrylate copolymer.

On the other hand, polystyrene (molecular weight Mp 21400) was dissolved in toluene to obtain a 20% solution, and undissolved components were filtered off to prepare a solution. The thus-prepared solution was added dropwise at a rate of 10 ml/min to methanol under agitation, and the precipitate was recovered, sufficiently dried under reduced pressure, and then re-precipitated to obtain polystyrene.

Toner particles were prepared by the porous glass film emulsion method below using thus-obtained reprecipitated styrene-butyl acrylate copolymer and reprecipitated polystyrene.

| | |
|---|---|
| Ion-exchange water | 100 parts |
| Sodium dodecylbenzenesulfate | 0.05 part |

The above materials were added to a first container to prepare a first continuous phase.

| | |
|---|---|
| Toluene | 50 parts |
| The above-prepared styrene-butyl acrylate copolymer | 20 parts |
| Oil Red | 2 parts |

On the other hand, the above materials were mixed to prepare a solution.

The solution was passed through a first phase splitting glass porous material under nitrogen pressure of 120 Kpa and pushed directly into the first continuous phase to be dispersed to obtain an O/W emulsion in which the first disperse phase of the solution was dispersed in the first continuous phase.

| | |
|---|---|
| Toluene | 300 parts |
| The above reprecipitated polystyrene | 10 parts |
| Styrene monomer | 1 part |
| Divinylbenzene | 0.5 part |
| 2,2'-azobis-(2,4-dimethylvaleronitrile) | 0.03 part |

The above materials were added to a second container to prepare a second continuous phase.

The above O/W emulsion was passed through a second phase splitting glass porous material subjected to hydrophobic treatment under nitrogen pressure of 32 KPa and pushed directly into the second continuous phase to be dispersed therein to obtain an O/W/O (oil/water/oil) emulsion in which the second disperse phase of the O/W emulsion was dispersed in the second continuous phase.

| | |
|---|---|
| Ion exchange water | 1000 parts |
| Polyvinyl alcohol | 1 part |
| Sodium dodecylbenzenesulfate | 0.1 part |

The above materials were poured into a third container and mixed to prepare a third continuous phase.

The above O/W/O emulsion was passed through a third phase splitting glass porous material under nitrogen pressure of 7.5 KPa and pushed directly into the third continuous phase to be dispersed therein to obtain an O/W/O/W (oil/water/oil/water) emulsion in which the O/W/O emulsion was dispersed in the third continuous phase.

The thus-obtained O/W/O/W emulsion was subjected to polymerization reaction at a reaction temperature of 50° C. in a nitrogen atmosphere for 6 hours. After reaction, the temperature was raised under agitation to volatilize toluene. Then, the remainder was washed with water, filtered and dried to obtain toner particles.

The thus-obtained toner particles had a number average particle size (Dn) of 5.88 μm, and a number distribution having a coefficient of variation of 18.9%.

The toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 101.0° C. and Tg2 was 47.2° C.

As a result of TEM observation of the thus-obtained toner particles by the same method as Example 1, a domain-matrix structure comprising a plurality of nuclear portions and a surface layer was observed. The toner radius r1 and the average minimum distance r2 from the surface to the nucleus were determined from the density difference of the dye. As a result, the ratio r1/r2 was 12.73.

As a result of measurement of the molecular weight of the toner particles, Mp of the molecular weight distribution was 25500, and the content of components having molecular weights of 1000 or less was 1.3% by weight of the toner particles.

1.0 part of hydrophobic titanium oxide fine powder having a BET value of 360 $m^2$ was externally added to the thus-obtained toner particles by mixing with a Henschel mixer.

10% by weight of toner and 90% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −26.3 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 7

| | |
|---|---|
| Methanol | 600 parts |
| Polyvinyl pyrrolidone | 60 parts |
| Styrene | 67 parts |
| n-butyl acrylate | 33 parts |
| Carbon black | 5 parts |
| Di-t-butylsalicylic acid metal compound | 1 part |
| 2,2'-azobis-(2-methylbutyronitrile) | 8.5 parts |

A mixture of the above materials was poured into a reactor with a reflux condenser, a thermometer, a nitrogen inlet tube, and a mechanical stirrer, and the mixed solution was sufficiently mixed under bubbling by blowing nitrogen at 400 ml/min for 20 minutes in the same manner as Example 1. The amount of the dissolved oxygen measured at the start of polymerization was 1.1 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 30 parts of styrene and 4 parts of n-butyl acrylate was added to the reactor at a rate of 10 parts per minute. Polymerization reaction was then effected for 12 hours under an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.41 μm and a number distribution having a coefficient of variation of 12.0%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 67.0° C. and Tg2 was 49.1° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 13.2.

As a result of measurement of the molecular weight of the toner particles, Mp of the molecular weight distribution was 21800, and the content of components having molecular weights of 1000 or less was 0.46% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −38.2 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 8

A mixture prepared by the same method as Example 7 was poured into the same reactor as Example 1, and the mixed solution was sufficiently mixed under bubbling by blowing nitrogen at 400 ml/min for 30 minutes. The amount of the dissolved oxygen measured at the start of polymerization was 1.1 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 30 parts of styrene and 1 part of n-butyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.39 μm and a number distribution having a coefficient of variation of 11.8%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 74.2° C. and Tg2 was 49.3° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 24.9.

As a result of measurement of the molecular weight of the toner particles, Mp of the molecular weight distribution was 20700, and the content of components having molecular weights of 1000 or less was 0.51% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −38.6 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 9

| | |
|---|---|
| Methanol | 600 parts |
| Polyvinyl pyrrolidone | 60 parts |
| Styrene | 60 parts |
| n-butyl acrylate | 40 parts |
| Carbon black | 5 parts |
| Di-t-butylsalicylic acid metal compound | 1 part |
| 2,2'-azobis-(2-methylbutyronitrile) | 8.5 parts |

A mixture of the above materials was poured into a reactor with a reflux condenser, a thermometer, a nitrogen inlet tube, and a mechanical stirrer, and the mixed solution was sufficiently mixed under bubbling by blowing nitrogen at 400 ml/min for 20 minutes in the same manner as Example 1. The amount of the dissolved oxygen measured at the start of polymerization was 1.0 mg/l. Polymerization reaction was then effected at a nitrogen flow rate of 40 ml/l and an oil bath temperature of 65° C. while monitoring the consumption of styrene by GC. When the consumption of styrene reached 70%, a mixture of 25 parts of styrene and 7 parts of n-butyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.42 μm and a number distribution having a coefficient of variation of 11.5%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 57.9° C. and Tg2 was 36.6° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 9.3.

As a result of measurement of the molecular weight of the toner particles, Mp of the molecular weight distribution was 21100, and the content of components having molecular weights of 1000 or less was 0.42% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −36.0 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 10

A mixture prepared by the same method as Example 1 was poured into the same reactor as Example 1, and the mixed solution was sufficiently mixed under bubbling by blowing nitrogen at 400 ml/min for 30 minutes. The amount of the dissolved oxygen measured at the start of polymerization was 1.1 mg/l. Polymerization reaction was then effected at a nitrogen flow rate of 40 ml/l and an oil bath temperature of 65° C. while monitoring the consumption of styrene by GC. When the consumption of styrene reached 50%, 60 parts of styrene was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.49 μm and a number distribution having a coefficient of variation of 12.1%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 75.5° C. and Tg2 was 44.6° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 4.8.

As a result of measurement of the molecular weight of the toner particles, Mp of the molecular weight distribution was 21600, and the content of components having molecular weights of 1000 or less was 0.44% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −37.5 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 11

A mixture prepared by the same method as Example 1 was poured into the same reactor as Example 1, and the mixed solution was sufficiently mixed under bubbling by blowing nitrogen at 400 ml/min for 30 minutes. The amount of the dissolved oxygen measured at the start of polymerization was 1.3 mg/l. Polymerization reaction was then effected at a nitrogen flow rate of 40 ml/l and an oil bath temperature of 65° C. while monitoring the consumption of styrene by GC. When the consumption of styrene reached 98%, a mixture of 10 parts of styrene and 1 part of n-butyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.32 μm and a number distribution having a coefficient of variation of 12.3%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 73.2° C. and Tg2 was 44.9° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 46.0.

As a result of measurement of the molecular weight of the toner particles, Mp of the molecular weight distribution was 22000, and the content of components having molecular weights of 1000 or less was 0.40% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −35.9 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Example 12

| | |
|---|---|
| Methanol | 600 parts |
| Polyvinyl pyrrolidone | 60 parts |
| Styrene | 71 parts |
| n-butyl acrylate | 29 parts |
| Carbon black | 5 parts |
| Di-t-butylsalicylic acid metal compound | 1 part |
| 2,2'-azobis-(2-methylbutyronitrile) | 8.5 parts |

A mixture of the above materials was poured into a reactor with a reflux condenser, a thermometer, a nitrogen inlet tube, and a mechanical stirrer, and the mixed solution was sufficiently mixed under bubbling by blowing nitrogen at 400 ml/min for 20 minutes in the same manner as Example 1. The amount of the dissolved oxygen measured at the start of polymerization was 1.1 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 27 parts of styrene and 8 parts of n-butyl acrylate was added to the reactor at a rate of 10 parts per minute. Polymerization reaction was then effected for 12 hours under an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.53 μm and a number distribution having a coefficient of variation of 12.3%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 61.3° C. and Tg2 was 55.2° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 12.15.

As a result of measurement of the molecular weight of the toner particles, Mp of the molecular weight distribution was 22600, and the content of components having molecular weights of 1000 or less was 0.41% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −36.5 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

The physical properties of the toner are shown in Table 1, and the results of evaluation are shown in Table 2.

Comparative Example 1

A mixture prepared by the same method as Example 1 was poured into the same reactor as Example 1, and the mixed solution was sufficiently mixed under bubbling by blowing nitrogen at 200 ml/min for 10 minutes. The amount of the dissolved oxygen measured at the start of polymerization was 3.5 mg/l. Polymerization reaction was then effected by the same method as Example 1.

After polymerization reaction was completed, the reactor was cooled to room temperature, and then methanol washing and decantation of the reaction dispersion were repeated 7 times. The thus-obtained slurry was dried to obtain toner particles having a number average particle size (Dn) of 3.87 μm and a number distribution having a coefficient of variation of 21.7%. In decantation, many fine particles of 1 μm or less were observed in the decantation supernatant.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 72.0° C. and Tg2 was 49.2° C. It is thought from this that styrene was early consumed relative to the initial amounts of styrene and n-butyl acrylate added.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 15.9.

As a result of measurement of the molecular weight of the toner particles, Mp of the molecular weight distribution was 18200, and the content of components having molecular weights of 1000 or less was 0.42% by weight of the toner particles.

2.0 parts of hydrophobic titanium oxide fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −33.5 μC/g.

A solid image and a halftone image were formed by using this two-component developer in the same manner as Example 1. The fixing start temperature, the solid image density, the reproducibility of the halftone image, and aggregation and reproducibility of the halftone image after the toner was allowed to stand at high temperature and high humidity were evaluated by the same method as Example 1.

With respect to the toner-reproducibility of the halftone image, although slight scattering was observed, the reproducibility of micro dots having small spot diameters which were developed on the surface of the photosensitive drum has no practical problem. However, the toner after being allowed to stand at high temperature and high humidity was slightly hardened due to packing, but the toner was returned to the state before being allowed to stand by shaking. With respect to the toner-reproducibility of the halftone image after the toner was allowed to stand, scattering significantly occurred, and the reproducibility of dots deteriorated, as compared with the reproducibility before the toner was allowed to stand.

The physical properties of the toner are shown in Table 1, and the results of evaluation are shown in Table 2.

Comparative Example 2

| | |
|---|---|
| Water | 600 parts |
| SDS (sodium dodecylbenzenesulfate) | 1 part |
| Polyvinyl alcohol | 5 parts |
| Styrene | 85 parts |
| n-butyl acrylate | 15 parts |
| Carbon black | 5 parts |
| Di-t-butylsalicylic acid metal compound | 1 part |
| 2,2'-azobis-(2-methylbutyronitrile) | 8 parts |

A mixture of the above materials was poured into a reactor, and the mixed solution was agitated for 10 minutes by TK homomixer at a rotational speed of 1000 rpm to form particles. The solution was then sufficiently mixed for 30 minutes while replacing the air in the reactor with argon at 400 ml/min. The amount of the dissolved oxygen measured at the start of polymerization was 30 mg/l. Polymerization reaction was then effected at an oil bath temperature of 70° C. for 12 hours in a nitrogen atmosphere.

After polymerization reaction was completed, the reactor was cooled to room temperature, and then washing with water and decantation of the reaction dispersion were repeated 5 times. The thus-obtained slurry was dried to obtain toner particles having a number average particle size (Dn) of 5.13 μm and a number distribution having a coefficient of variation of 30.5%. In decantation, many fine particles of 1 μm or less were observed in the decantation supernatant.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 62.4° C. and Tg2 was 63.1° C. It was found from this that the particles have a uniform structure.

As a result of TEM observation of the thus-obtained toner particles by the same method as Example 1, a capsule structure was not observed.

As a result of measurement of the molecular weight of the toner particles, Mp of the molecular weight distribution was 21200, and the content of components having molecular weights of 1000 or less was 5.33% by weight of the toner particles.

1.0 part of hydrophobic silica fine powder having a BET value of 360 $m^2$ was externally added to the thus-obtained toner particles by mixing with a Henschel mixer.

10% by weight of toner and 90% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −28.1 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

With respect to the toner-reproducibility of the halftone image, the reproducibility of micro-spots having small spot diameters which were developed on the surface of the photosensitive drum slightly deteriorated. The toner after being allowed to stand at high temperature and high humidity was slightly hardened, but was returned to the state before being allowed to stand by shaking. The toner-reproducibility of the halftone image after the toner was allowed to stand slightly deteriorated in the same manner as the toner before being allowed to stand. Furthermore, as a result of the fixing test, the fixing start temperature was 138° C.

The physical properties of the toner are shown in Table 1, and the results of evaluation are shown in Table 2.

Comparative Example 3

A mixture prepared by the same method as Comparative Example 2 was agitated for 10 minutes by TK homomixer at a rotational speed of 9000 rpm to form particles. The solution was then sufficiently mixed for 30 minutes while replacing the air in the reactor with argon at 400 ml/min. The amount of the dissolved oxygen measured at the start of polymerization was 24 mg/l. Polymerization reaction was then effected at an oil bath temperature of 70° C. for 12 hours in a nitrogen atmosphere.

After polymerization reaction was completed, the reactor was cooled to room temperature, and then washing with water and decantation of the reaction dispersion were repeated 5 times. The thus-obtained slurry was dried to obtain black resin particles having a number average particle size (Dn) of 6.57 μm and a number distribution having a coefficient of variation of 28.5%. In decantation, many fine particles of 1 μm or less were observed in the decantation supernatant.

The thus-obtained black resin particles were classified by using a multi-division classifier which employs inertia force to obtain toner particles having a number average particle size (Dn) of 6.95 μm and a number distribution having a coefficient of variation of 18.8%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 62.0° C. and Tg2 was 62.2° C. It was found from this that the particles have a uniform structure.

As a result of TEM observation of the thus-obtained toner particles by the same method as Example 1, a capsule structure was not observed.

As a result of measurement of the molecular weight of the toner particles, Mp of the molecular weight distribution was 20800, and the content of components having molecular weights of 1000 or less was 6.19% by weight of the toner particles.

0.7 part of hydrophobic silica fine powder having a BET value of 360 $m^2$ was externally added to the thus-obtained toner particles by mixing with a Henschel mixer.

12% by weight of toner and 88% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −22.7 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

With respect to the toner-reproducibility of the halftone image, the reproducibility of micro-spots having small spot diameters which were developed on the surface of the photosensitive drum slightly deteriorated, and scattering occurred. The toner after being allowed to stand at high temperature and high humidity exhibited less aggregation. With respect to the toner-reproducibility of the halftone image after the toner was allowed to stand, the reproducibility of micro-dots slightly deteriorated in the same manner as the toner before being allowed to stand.

The physical properties of the toner are shown in Table 1, and the results of evaluation are shown in Table 2.

Comparative Example 4

| | |
|---|---|
| Methanol | 600 parts |
| Polyvinyl pyrrolidone | 60 parts |
| Styrene | 80 parts |
| n-butyl acrylate | 20 parts |
| Carbon black | 5 parts |
| Di-t-butylsalicylic acid metal compound | 1 part |
| 2,2'-azobis-(2-methylbutyronitrile) | 8.5 parts |

A mixture of the above materials was poured into a reactor with a reflux condenser, a thermometer, a nitrogen inlet tube, and a mechanical stirrer, and the mixed solution was sufficiently mixed under bubbling by blowing nitrogen at 400 ml/min for 20 minutes in the same manner as Example 1. The amount of the dissolved oxygen measured at the start of polymerization was 1.3 mg/l. Polymerization reaction was then effected at a nitrogen flow rate of 40 ml/l and an oil bath temperature of 65° C. while monitoring the consumption of styrene by GC. When the consumption of styrene reached 80%, a mixture of 15 parts of styrene and 14 parts of n-butyl acrylate was added to the reactor at a rate of 10 parts per minute. Polymerization reaction was then effected for 12 hours in an atmosphere of nitrogen.

After polymerization reaction was completed, the reactor was cooled to room temperature, and then methanol washing and decantation of the reaction dispersion were repeated 5 times. The thus-obtained slurry was dried to obtain toner particles having a number average particle size (Dn) of 3.50 μm and a number distribution having a coefficient of variation of 15.3%.

The thus-obtained toner particles were extracted with a solvent mixture of EtOH and MEK by the same method as Example 1. The maximum glass transition temperature (Tg1) of the first soluble resin component and the maximum glass transition temperature (Tg2) of the second soluble resin component were measured. As a result, Tg1 was 50.3° C. and Tg2 was 65.3° C.

As a result of TEM observation of the thus-obtained toner particles by the same method as Example 1, a two-layer structure comprising a nuclear portion and a surface layer was observed. The toner radius r1 and the average minimum distance r2 from the surface to the nucleus were determined from the density difference of the dye. As a result, the ratio r1/r2 was 14.1.

As a result of measurement of the molecular weight of the toner particles, Mp of the molecular weight distribution was 21300, and the content of components having molecular weights of 1000 or less was 0.51% by weight of the toner particles.

2.0 parts of hydrophobic silica fine powder having a BET value of 360 $m^2$ was externally added to the thus-obtained toner particles by mixing with a Henschel mixer.

6% by weight of toner and 94% by weight of carrier comprising ferrite cores having an average particle size of 35 μm and coated with silicone resin were placed in a polyethylene bottle and then mixed and agitated by a tubular mixer to prepare a two-component developer. The frictional charge of the thus-prepared two-component developer was −36.6 μC/g.

A solid image and a halftone image were formed by using this two-component developer in the same manner as Example 1. The fixing start temperature, the solid image density, the toner-reproducibility of the halftone image, and aggregation and toner-reproducibility of the halftone image after the toner was allowed to stand at high temperature and high humidity were evaluated by the same method as Example 1.

As a result, the toner-reproducibility of the halftone image was excellent. The toner after being allowed to stand a high temperature and high humidity significantly aggregated, and was not returned to the state before the toner was allowed to stand. With respect to the toner-reproducibility of the halftone image after the toner was allowed to stand, the dots to be developed were not developed, and thus reproducibility was poor.

The physical properties of the toner are shown in Table 1, and the results of evaluation are shown in Table 2.

TABLE 1

| | Particle size (μm) A | Coefficient of variation (%) B | Tg1 | Tg2 | Tg1−Tg2 | r1/r2 | Mp | Content of component (wt %) C |
|---|---|---|---|---|---|---|---|---|
| Example 1 | 3.37 | 11.0 | 76.2 | 45.0 | 31.0 | 13.8 | 20500 | 0.35 |
| Example 2 | 5.82 | 15.9 | 74.4 | 46.3 | 28.1 | 15.1 | 18100 | 0.40 |
| Example 3 | 1.40 | 13.9 | 77.7 | 47.8 | 29.9 | 14.1 | 26800 | 0.21 |
| Example 4 | 3.56 | 14.5 | 92.1 | 34.0 | 58.1 | 5.98 | 21600 | 0.32 |
| Example 5 | 3.40 | 17.0 | 67.0 | 35.0 | 32.0 | 5.99 | 21100 | 0.38 |
| Example 6 | 5.88 | 18.9 | 101.0 | 47.2 | 53.8 | 12.73 | 25500 | 1.30 |
| Example 7 | 3.41 | 12.0 | 67.0 | 49.1 | 17.0 | 13.2 | 21800 | 0.46 |
| Example 8 | 3.39 | 11.8 | 74.2 | 49.3 | 24.9 | 14.8 | 20700 | 0.51 |
| Example 9 | 3.42 | 11.5 | 57.9 | 36.6 | 21.3 | 9.3 | 21100 | 0.42 |

TABLE 1-continued

| | Particle size (μm) A | Coefficient of variation (%) B | Tg1 | Tg2 | Tg1−Tg2 | r1/r2 | Mp | Content of component (wt %) C |
|---|---|---|---|---|---|---|---|---|
| Example 10 | 3.49 | 12.1 | 75.5 | 44.6 | 30.9 | 4.8 | 21600 | 0.44 |
| Example 11 | 3.32 | 12.3 | 73.2 | 44.9 | 28.3 | 46.0 | 22000 | 0.40 |
| Example 12 | 3.53 | 12.3 | 60.3 | 55.2 | 5.1 | 12.15 | 22600 | 0.41 |
| Comp. Example 1 | 3.78 | 21.7 | 72.0 | 49.2 | 22.8 | 15.9 | 18200 | 0.42 |
| Comp. Example 2 | 5.13 | 30.5 | 62.4 | 63.1 | −0.7 | —*1 | 21200 | 5.33 |
| Comp. Example 3 | 6.95 | 18.8 | 62.0 | 62.2 | −0.2 | —*2 | 20800 | 6.19 |
| Comp. Example 4 | 3.50 | 15.3 | 50.3 | 65.3 | −15.0 | 14.1 | 21300 | 0.51 |

A: Number average particle size
B: Coefficient of variation based on the number distribution
C: Content of component having a molecular weight of 1000 or less

TABLE 2

| | Image density | Toner-reproducibility of halftone image | Aggregation * | Toner-reproducibility of halftone image* | Fixing start temperature (°C.) | Frictional charge (μc/g) |
|---|---|---|---|---|---|---|
| Example 1 | 1.52 | A | A | A | 125 | −35.1 |
| Example 2 | 1.50 | B | A | B | 126 | −27.8 |
| Example 3 | 1.46 | A | B | A | 130 | −43.9 |
| Example 4 | 1.49 | A | B | A | 126 | −36.8 |
| Example 5 | 1.48 | A | C | B | 118 | −35.0 |
| Example 6 | 1.48 | B | A | B | 132 | −26.3 |
| Example 7 | 1.50 | A | B | B | 126 | −38.2 |
| Example 8 | 1.49 | A | B | A | 128 | −38.6 |
| Example 9 | 1.52 | A | C | B | 124 | −36.0 |
| Example 10 | 1.51 | A | A | A | 133 | −37.5 |
| Example 11 | 1.50 | A | C | B | 123 | −35.9 |
| Example 12 | 1.50 | A | B | B | 128 | −36.5 |
| Comparative Example 1 | 1.46 | C | C | D | 133 | −33.5 |
| Comparative Example 2 | 1.48 | D | C | D | 138 | −28.1 |

TABLE 2-continued

| | Image density | Toner-reproducibility of halftone image | Aggregation * | Toner-reproducibility of halftone image* | Fixing start temperature (°C.) | Frictional charge (μc/g) |
|---|---|---|---|---|---|---|
| Comparative Example 3 | 1.55 | D | B | D | 139 | −22.7 |
| Comparative Example 4 | 1.46 | A | D | E | 125 | −36.6 |

*) After allowing to stand at high temperature and high humidity (30° C., 80% RH) for 7 days

What is claimed is:

1. A toner for developing an electrostatic image comprising at least a binder resin and a colorant, wherein:

the toner (i) contains 0.1 to 15 parts by weight of colorant per 100 parts by weight of binder resin, (ii) has a number average particle size of 0.5 to 6.0 μm, (iii) has a coefficient of variation of 20% or less based on a number distribution, (iv) has a capsule structure comprising a shell layer and a core; and said toner has solvent-mixture-soluble resin components extracted with a solvent mixture of ethanol and methyl ethyl ketone, the maximum glass transition temperature (Tg1) of a first soluble resin component obtained by extracting until 10% by weight of the total weight of the solvent mixture soluble resin components, and the maximum glass transition temperature (Tg2) of a second soluble resin component of the remainder satisfy the following relations:

$$Tg1>Tg2 \text{ and } Tg1\geqq 50^\circ \text{ C.}$$

2. The toner according to claim 1, wherein the toner has a number average particle size of 1.0 to 5.0 μm.

3. The toner according to claim 1, wherein the toner has a coefficient of variation of 18% or less based on a number distribution.

4. The toner according to claim 1, wherein the maximum glass transition temperature (Tg1) of the first soluble resin component and the maximum glass transition temperature (Tg2) of the second soluble resin component satisfy the following additional relation:

$$Tg1-Tg2\geqq 20^\circ \text{ C.}$$

5. The toner according to claim 1, wherein the maximum glass transition temperature (Tg1) of the first soluble resin component and the maximum glass transition temperature (Tg2) of the second soluble resin component satisfy the following additional relation:

$$80^\circ \text{ C.}\geqq Tg1-Tg2\geqq 30^\circ \text{ C.}$$

6. The toner according to claim 1, wherein the maximum glass transition temperature (Tg2) of the second soluble resin component is less than 50° C.

7. The toner according to claim 1, wherein the tetrahydrofuran-soluble component of the toner contains 0.5% by weight or less of components having molecular weights of 1000 or less in a GPC molecular weight distribution of the tetrahydrofuran-soluble component.

8. The toner according to claim 1, wherein the toner has a capsule structure comprising a single core portion.

9. The toner according to claim 1, wherein the toner has a capsule structure comprising a plurality of core portions.

10. The toner according to claim 1, wherein when the radius of the toner having a capsule structure is r1, and the distance to a surface position of a core portion at a minimum distance from the toner surface is r2, r1 and r2 satisfy the following relation:

$$1.1\leqq r1/r2\leqq 100.$$

11. The toner according to claim 1, wherein when the radius of the toner having a capsule structure is r1, and the distance to a surface position of a core portion at a minimum distance from the toner surface is r2, r1 and r2 satisfy the following relation:

$$2.0\leqq r1/r2\leqq 50.$$

12. The toner according to claim 1, wherein when the radius of the toner having a capsule structure is r1, and the distance to a surface position of a core portion at a minimum distance from the toner surface is r2, r1 and r2 satisfy the following relation:

$$5.0\leqq r1/r2\leqq 40.$$

13. The toner according to claim 1, wherein the toner comprises toner particles containing at least a binder resin and a colorant, and an external additive which is externally added to the toner particles.

14. The toner according to claim 13, wherein the external additive comprises a fine powder having a BET specific surface areas of at least 300 $m^2/g$.

15. A process for producing a toner comprising the steps of:

(a) dissolving, in a polymerization solvent, a first polymerizable monomer which is soluble in the polymerization solvent and which, by polymerization, produces a polymer insoluble in the polymerization solvent, and a polymer composition, to prepare a polymerization reaction system;

(b) polymerizing the first polymerizable monomer in the presence of a polymerization initiator in the polymerization reaction system wherein dissolved oxygen in the polymerization reaction system is initially set to 2.0 mg/l;

(c) after polymerizing at least 50% of the first polymerizable monomer adding to the polymerization reaction system a second polymerizable monomer which is soluble in the polymerization solvent, which, by polymerization, produces a polymer insoluble in the polymerization solvent and from which a polymer having a higher glass transition temperature than that of the polymer synthesized from the first polymerizable monomer can be synthesized;

(d) polymerizing the second polymerizable monomer in the polymerization reaction system;

(e) recovering polymerization particles from the polymerization reaction system; and (f) producing a toner comprising at least a colorant and a binder resin from the resultant polymerization particles; wherein;

the toner (i) contains 0.1 to 15 parts by weight of colorant per 100 parts by weight of binder resin, (ii) has a number average particle size of 0.5 to 6.0 μm, (iii) has a coefficient of variation of 20% or less based on a number distribution, and (iv) has a capsule structure containing a shell layer and a core; said toner has solvent-mixture-soluble resin components extracted with a solvent mixture of ethanol and methyl ethyl ketone, the maximum glass transition temperature (Tg1) of a first soluble resin component obtained by extracting until 10% by weight of the total weight of the solvent mixture soluble resin components, and the maximum glass transition temperature (Tg2) of a second soluble resin component of the remainder satisfy the following relations:

$$Tg1>Tg2 \text{ and } Tg1\geqq 50^\circ C.$$

16. The process according to claim 15, wherein the amount of the dissolved oxygen in the polymerization reaction system at the start of polymerization of the first polymerizable monomer in the polymerization reaction system is no greater than 1.0 mg/l.

17. The process according to claim 15, wherein the amount of the dissolved oxygen in the polymerization reaction system at the start of polymerization of the first polymerizable monomer in the polymerization reaction system is set to no greater than 2.0 mg/l by bubbling and blowing an inert gas in the polymerization reaction system.

18. The process according to claim 15, wherein the amount of the dissolved oxygen in the polymerization reaction system at the start of polymerization of the first polymerizable monomer in the polymerization reaction system is set to no greater than 2.0 mg/l by deoxidizing by applying ultrasonic waves to the polymerization reaction system.

19. The process according to claim 15, wherein the amount of the dissolved oxygen in the polymerization reaction system at the start of polymerization of the first polymerizable monomer in the polymerization reaction system is set to no greater than 2.0 mg/l by bubbling and blowing an inert gas in the polymerization reaction system and deoxidizing by applying ultrasonic waves to the polymerization reaction system.

20. The process according to claim 15, wherein when the polymerization of the first polymerizable monomer reaches a conversion of 60 to 95%, the second polymerizable monomer is added to the polymerization reaction system.

21. The process according to claim 15, wherein the polymer composition soluble in the polymerization solvent has a weight average molecular weight of 3,000 to 300,000.

22. The process according to claim 15, wherein the polymer composition soluble in the polymerization solvent is dissolved in the polymerization solvent in an amount of 0.1 to 50% by weight based on the weight of the polymerization solvent.

23. The process according to claim 15, wherein the first polymerization monomer is at least one monomer selected from the group consisting of styrene monomers, acrylic acid monomers, vinyl ether monomers, dibasic acid monomers and heterocyclic monomers, and the second polymerizable monomer is at least one monomer selected from the group consisting of styrene monomers, acrylic acid monomers, vinyl ether monomers, dibasic acid monomers and heterocyclic monomers.

24. The process according to claim 15, wherein the colorant is added to the polymerization reaction system together with the first polymerizable monomer so as to be contained in the toner by polymerization of the first polymerizable monomer.

25. The process according to claim 15, wherein the colorant is added to the polymerization reaction system together with the second polymerizable monomer so as to be contained in the toner by polymerization of the second polymerizable monomer.

26. The process according to claim 15, wherein the colorant is added to a hot solvent together with the polymerization particles so as to be contained in the toner by dyeing the polymerization particles with the colorant in the hot solvent.

* * * * *

UNITED STATES PATENT AND TRADEMARK OFFICE

CERTIFICATE OF CORRECTION

PATENT NO. : 5,744,278

DATED : April 28, 1998

INVENTOR(S) : YASUKAZU AYAKI, ET AL.

It is certified that error appears in the above-identified patent and that said Letters Patent is hereby corrected as shown below:

COLUMN 3

Line 23, "wherein;" should read --wherein:--.

COLUMN 9

Line 26, "vinylphenol(meth)acrylate" should read --vinylphenol-(meth)acrylate--; and
Line 27, "styrene-vinylphenol(meth)acrylate" should read --styrene-vinylphenol-(meth)acrylate--.

COLUMN 10

Line 11, "tertbutyl" should read --tert-butyl--; and
Line 27, "p-menthane," should read --p-methane,--.

COLUMN 12

Line 27, "navel" should read --naval--; and
Line 67, "Orange-PR." should read --Orange-PR,--.

COLUMN 13

Line 1, "Scarlet#308," should read --Scarlet-#308,--.

COLUMN 14

Line 59, "spitting" should read --splitting--; and
Line 64, "spitting" should read --splitting--.

COLUMN 37

Line 33, "stand" should read --stand at--.

UNITED STATES PATENT AND TRADEMARK OFFICE

CERTIFICATE OF CORRECTION

PATENT NO. : 5,744,278

DATED : April 28, 1998

INVENTOR(S) : YASUKAZU AYAKI, ET AL.

It is certified that error appears in the above-identified patent and that said Letters Patent is hereby corrected as shown below:

COLUMN 38

Line 32, Insert: --*1 and *2: No capsule structure was observed.--.

COLUMN 40

Line 37, "areas" should read --area--;
Line 67, "wherein;" should read --wherein:--.

COLUMN 41

Line 34, "by deoxidizing" should read --and deoxidizing--.

Signed and Sealed this

Nineteenth Day of January, 1999

*Attest:*

*Attesting Officer*

*Acting Commissioner of Patents and Trademarks*